US008831933B2

(12) United States Patent
Duni et al.

(10) Patent No.: US 8,831,933 B2
(45) Date of Patent: Sep. 9, 2014

(54) SYSTEMS, METHODS, APPARATUS, AND COMPUTER-READABLE MEDIA FOR MULTI-STAGE SHAPE VECTOR QUANTIZATION

(75) Inventors: Ethan Robert Duni, San Diego, CA (US); Venkatesh Krishnan, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 418 days.

(21) Appl. No.: 13/193,476

(22) Filed: Jul. 28, 2011

(65) Prior Publication Data

US 2012/0029924 A1 Feb. 2, 2012

Related U.S. Application Data

(60) Provisional application No. 61/369,662, filed on Jul. 30, 2010, provisional application No. 61/369,705, filed on Jul. 31, 2010, provisional application No. 61/369,751, filed on Aug. 1, 2010, provisional application No. 61/374,565, filed on Aug. 17, 2010, provisional application No. 61/384,237, filed on Sep. 17, 2010, provisional application No. 61/470,438, filed on Mar. 31, 2011.

(51) Int. Cl.

| | |
|---|---|
| ***G10L 19/12*** | (2013.01) |
| ***G10L 25/90*** | (2013.01) |
| ***G10L 19/038*** | (2013.01) |
| *G10L 19/093* | (2013.01) |

(52) U.S. Cl.

CPC ..... *G10L 25/90* (2013.01); *G10L 19/038* (2013.01); *G10L 19/093* (2013.01)

USPC ..... 704/222

(58) Field of Classification Search

CPC ..... G10L 19/038

See application file for complete search history.

(56) References Cited

U.S. PATENT DOCUMENTS

| | | | | |
|---|---|---|---|---|
| 3,978,287 | A | 8/1976 | Fletcher et al. | |
| 4,516,258 | A | 5/1985 | Ching et al. | |
| 4,964,166 | A | 10/1990 | Wilson | |
| 5,222,146 | A * | 6/1993 | Bahl et al. | 704/243 |
| 5,309,232 | A | 5/1994 | Hartung et al. | |
| 5,321,793 | A | 6/1994 | Drogo De Iacovo et al. | |

(Continued)

FOREIGN PATENT DOCUMENTS

| | | | |
|---|---|---|---|
| CN | 1207195 | A | 2/1999 |
| CN | 1239368 | A | 12/1999 |

(Continued)

OTHER PUBLICATIONS

Allott, D., and R. J. Clarke. "Shape adaptive activity controlled multistage gain shape vector quantisation of images." Electronics Letters 21.9 (1985): 393-395.*

(Continued)

*Primary Examiner* — Brian Albertalli

(74) *Attorney, Agent, or Firm* — Austin Rapp & Hardman

(57) ABSTRACT

A multistage shape vector quantizer architecture uses information from a selected first-stage codebook vector to generate a rotation matrix. The rotation matrix is used to rotate the direction of the input vector to support shape quantization of the first-stage quantization error.

40 Claims, 17 Drawing Sheets

(56) References Cited

U.S. PATENT DOCUMENTS

| | | | | |
|---|---|---|---|---|
| 5,388,181 | A | 2/1995 | Anderson et al. | |
| 5,479,561 | A | 12/1995 | Kim | |
| 5,630,011 | A | 5/1997 | Lim et al. | |
| 5,664,057 | A | 9/1997 | Crossman et al. | |
| 5,692,102 | A | 11/1997 | Pan | |
| 5,781,888 | A | 7/1998 | Herre | |
| 5,842,160 | A | 11/1998 | Zinser | |
| 5,978,762 | A | 11/1999 | Smyth et al. | |
| 5,999,897 | A | 12/1999 | Yeldener | |
| 6,035,271 | A | 3/2000 | Chen | |
| 6,064,954 | A | 5/2000 | Cohen et al. | |
| 6,078,879 | A | 6/2000 | Taori et al. | |
| 6,094,629 | A | 7/2000 | Grabb et al. | |
| 6,098,039 | A | 8/2000 | Nishida | |
| 6,236,960 | B1 | 5/2001 | Peng et al. | |
| 6,246,345 | B1 | 6/2001 | Davidson et al. | |
| 6,301,556 | B1 | 10/2001 | Hagen et al. | |
| 6,308,150 | B1 | 10/2001 | Neo et al. | |
| 6,424,939 | B1 | 7/2002 | Herre et al. | |
| 6,593,872 | B2 | 7/2003 | Makino et al. | |
| 6,766,288 | B1 | 7/2004 | Smith | |
| 6,952,671 | B1 | 10/2005 | Kolesnik et al. | |
| 7,069,212 | B2 | 6/2006 | Tanaka et al. | |
| 7,272,556 | B1 | 9/2007 | Aguilar et al. | |
| 7,340,394 | B2 | 3/2008 | Chen et al. | |
| 7,493,254 | B2 | 2/2009 | Jung et al. | |
| 7,613,607 | B2 | 11/2009 | Valve et al. | |
| 7,660,712 | B2 | 2/2010 | Gao et al. | |
| 7,885,819 | B2 | 2/2011 | Koishida et al. | |
| 7,912,709 | B2 | 3/2011 | Kim | |
| 8,111,176 | B2 * | 2/2012 | Tosato et al. | 341/50 |
| 8,364,471 | B2 | 1/2013 | Yoon et al. | |
| 8,370,133 | B2 | 2/2013 | Taleb et al. | |
| 8,493,244 | B2 * | 7/2013 | Satoh et al. | 341/50 |
| 2001/0023396 | A1 | 9/2001 | Gersho et al. | |
| 2002/0161573 | A1 | 10/2002 | Yoshida | |
| 2002/0169599 | A1 | 11/2002 | Suzuki | |
| 2003/0061055 | A1 | 3/2003 | Taori et al. | |
| 2003/0233234 | A1 | 12/2003 | Truman et al. | |
| 2004/0133424 | A1 | 7/2004 | Ealey et al. | |
| 2004/0196770 | A1 | 10/2004 | Touyama et al. | |
| 2005/0080622 | A1 | 4/2005 | Dieterich et al. | |
| 2006/0015329 | A1 | 1/2006 | Chu | |
| 2006/0036435 | A1 | 2/2006 | Kovesi et al. | |
| 2007/0271094 | A1 | 11/2007 | Ashley et al. | |
| 2007/0282603 | A1 | 12/2007 | Bessette | |
| 2007/0299658 | A1 | 12/2007 | Wang et al. | |
| 2008/0027719 | A1 | 1/2008 | Kirshnan et al. | |
| 2008/0052066 | A1 | 2/2008 | Oshikiri et al. | |
| 2008/0126904 | A1 | 5/2008 | Sung et al. | |
| 2008/0234959 | A1 | 9/2008 | Joublin et al. | |
| 2008/0310328 | A1 | 12/2008 | Li et al. | |
| 2008/0312758 | A1 | 12/2008 | Koishida et al. | |
| 2008/0312914 | A1 | 12/2008 | Rajendran et al. | |
| 2009/0177466 | A1 | 7/2009 | Rui et al. | |
| 2009/0187409 | A1 | 7/2009 | Krishnan et al. | |
| 2009/0234644 | A1 | 9/2009 | Reznik et al. | |
| 2009/0271204 | A1 | 10/2009 | Tammi | |
| 2009/0299736 | A1 | 12/2009 | Sato | |
| 2009/0319261 | A1 | 12/2009 | Gupta et al. | |
| 2010/0017198 | A1 | 1/2010 | Yamanashi et al. | |
| 2010/0054212 | A1 | 3/2010 | Tang | |
| 2010/0121646 | A1 | 5/2010 | Ragot et al. | |
| 2010/0169081 | A1 | 7/2010 | Yamanashi et al. | |
| 2010/0280831 | A1 | 11/2010 | Salami et al. | |
| 2011/0173012 | A1 | 7/2011 | Rettelbach et al. | |
| 2011/0178795 | A1 | 7/2011 | Bayer et al. | |
| 2012/0029923 | A1 | 2/2012 | Rajendran et al. | |
| 2012/0029925 | A1 | 2/2012 | Duni et al. | |
| 2012/0029926 | A1 | 2/2012 | Krishnan et al. | |
| 2012/0046955 | A1 | 2/2012 | Rajendran et al. | |
| 2013/0013321 | A1 | 1/2013 | Oh et al. | |
| 2013/0117015 | A1 | 5/2013 | Bayer et al. | |
| 2013/0144615 | A1 | 6/2013 | Rauhala et al. | |
| 2013/0218577 | A1 | 8/2013 | Taleb et al. | |

FOREIGN PATENT DOCUMENTS

| | | | |
|---|---|---|---|
| CN | 1367618 | A | 9/2002 |
| CN | 101030378 | A | 9/2007 |
| CN | 101523485 | A | 9/2009 |
| CN | 101622661 | A | 1/2010 |
| JP | 63033935 | | 2/1988 |
| JP | S6358500 | A | 3/1988 |
| JP | H01205200 | A | 8/1989 |
| JP | H07273660 | A | 10/1995 |
| JP | H09244694 | A | 9/1997 |
| JP | H09288498 | A | 11/1997 |
| JP | H1097298 | A | 4/1998 |
| JP | H11502318 | A | 2/1999 |
| JP | 11-224099 | | 8/1999 |
| JP | 2001044844 | A | 2/2001 |
| JP | 2001249698 | A | 9/2001 |
| JP | 2002542522 | A | 12/2002 |
| JP | 2004246038 | A | 9/2004 |
| JP | 2004538525 | A | 12/2004 |
| JP | 2005527851 | A | 9/2005 |
| JP | 2006301464 | A | 11/2006 |
| JP | 2010518422 | A | 5/2010 |
| WO | WO03015077 | A1 | 2/2003 |
| WO | WO-03088212 | A1 | 10/2003 |
| WO | WO-03107329 | A1 | 12/2003 |
| WO | WO-2009029036 | A1 | 3/2009 |
| WO | WO2010003565 | A1 | 1/2010 |
| WO | WO2010081892 | A2 | 7/2010 |

OTHER PUBLICATIONS

3GPP TS 26.290 v8.0.0.,"Audio codec processing functions; Extended Adaptive Multi-rate-Wideband (AMR-WB+) codec; Transcoding functions", Release 8, pp. 1-87, (Dec. 2008).

3GPP2 C.S00014-D, v2.0, "Enhanced Variable Rate Codec, Speech Service Options 3, 68, 70, and 73 for Wideband Spread Spectrum Digital Systems", 3GPP2 (3rd Generation Partnership Project 2), Telecommunications Industry Association, Arlington, VA., pp. 1-308 (Jan. 25, 2010).

ITU-T G.729.1 (May 2006), Series G: Transmission Systems and Media, Digital Systems and Networks, Digital terminal equipments—Coding of analogue signals by methods other than PCM, G.729-based embedded variable bit-rate coder: An 8-32 kbits/ scalable wideband coder bitstream interoperable with G.729, 100pp.

Mehrotra S. et al., "Low Bitrate Audio Coding Using Generalized Adaptive Gain Shape Vector Quantization Across Channels", Proceeding ICASSP '09 Proceedings of the 2009 IEEE International Conference on Acoustics, Speech and Signal Processing, Apr. 2009, pp. 1-4, IEEE Computer Society.

Murashima, A., et al., "A post-processing technique to improve coding quality of CELP under background noise" Proc. IEEE Workshop on Speech Coding, pp. 102-104 (Sep. 2000).

Oger, M., et al., "Transform audio coding with arithmetic-coded scalar quantization and model-based bit allocation" ICASSP, pp. IV-545-IV-548 (2007).

Oshikiri, M. et al., "Efficient Spectrum Coding for Super-Wideband Speech and Its Application to 7/10/15 KHZ Bandwidth Scalable Coders", Acoustics, Speech, and Signal Processing, 2004. Proceedings. (ICASSP '04). IEEE International Conference on, May 2004, p. I-481-4, vol. 1.

Rongshan, Yu, et al., "High Quality Audio Coding Using a Novel Hybrid WLP-Subband Coding Algorithm," Fifth International Symposium on Signal Processing and its Applications, ISSPA '99, Brisbane, AU, Aug. 22-25, 1999, pp. 483-486.

Adoul J-P, et al., "Baseband speech coding at 2400 BPS using spherical vector quantization", International Conference on Acoustics, Speech & Signal Processing. ICASSP. San Diego, Mar. 19-21, 1984; [International Conference on Acoustics, Speech & Signal Processing. ICASSP], New York, IEEE, US, vol. 1, Mar. 19, 1984, pp. 1.12/1-1.12/4, XP002301076.

Bartkowiak Maciej, et al., "Harmonic Sinusoidal + Noise Modeling of Audio Based on Multiple FO Estimation", AES Convention 125; Oct. 2008, AES, 60 East 42nd Street, Room 2520 New York 10165-2520, USA, Oct. 1, 2008, XP040508748.

(56) References Cited

OTHER PUBLICATIONS

Bartkwiak et al.,"A unifying Approach to Transfor, and Sinusoidal Coding of Audio", AES Convention 124; May 2008, AES, 60 East 42nd Street, Room 2520 New York 10165-2520, USA, May 1, 2008, XP040508700, Section 2.2-4, Figure 3.

Chunghsin Yeh, et al., "Multiple Fundamental Frequency Estimation of Polyphonic Music Signals", 2005 IEEE International Conference on Acoustics, Speech, and Signal Processing—Mar. 18-23, 2005—Philadelphia, PA, USA, IEEE, Piscataway, NJ, vol. 3, Mar. 18, 2005, pp. 225-228, XP010792370, DOI: 10.1109/ICASSP.2005.1415687 ISBN: 978-0-7803-8874-1.

Doval B, et al., "Estimation o f fundamental frequency of musical sound signals", Speech Processing 1. Toronto, May 14-17, 1991; [International Conference on Acoustics, Speech & Signal Processing. ICASSP], New York, IEEE, US, vol. CONF. 16, Apr. 14, 1991, pp. 3657-3660, XP010043661, DOI: 10.1109/ICASSP.1991.151067 ISBN: 978-0-7803-0003-3.

International Search Report and Written Opinion—PCT/US2011/045858—ISA/EPO—Feb. 17, 2012.

Lee D H et al: "Cell-conditioned multistage vector quantization", Speech Processing 1. Toronto, May 14-17, 1991; [International Conference on Acoustics, Speech & Signal Processing.ICASSP], New York, IEEE,US, vol. CONF.16, Apr. 14, 1991, pp. 653-656, XP010043060, DOI: 10.1109/ICASSP.1991.150424 ISBN: 978-0-7803-0003-3.

Paiva Rui Pedro, et al., "A Methodology for Detection of Melody in Polyphonic Musical Signals", AES Convention 116; May 2004, AES, 60 East 42nd Street, Room 2520 New York 10165-2520, USA, May 1, 2004, XP040506771.

Cardinal, J., "A fact full search equivalent for mean-shape-gain vector quantizers," 20th Symp. on Inf. Theory in the Benelux, 1999, 8 pp.

Matschkal, B. et al. "Joint Signal Processing for Spherical Logarithmic Quantization and DPCM," 6th Int'l ITG-Conf. on Source and Channel Coding, Apr. 2006, 6 pp.

Mittal, U., et al., "Low complexity factorial pulse coding of MDCT coefficients using approximation of combinatorial functions" 2007 IEEE International Conference on Acoustics, Speech, and Signal Processing Apr. 15-20, 2007 Honolulu, HI, USA, Apr. 15, 2007, pp. I-289 to I-292, XP002510838 ISBN: 1-4244-0727-3.

Oehler, K.L. et al., "Mean-gain-shape vector quantization," ICASSP 1993, pp. V-241-V-244.

Sampson, D., et al., "Fast lattice-based gain-shape vector quantisation for image-sequence coding," IEE Proc.-I, vol. 140, No. 1, Feb. 1993, pp. 56-66.

Terriberry, T.B. Pulse Vector Coding, 3 pp. Available online Jul. 22, 2011 at http://people.xiph.org/~tterribe/notes/cwrs.html.

Valin, J-M. et al., "A full-bandwidth audio codec with low complexity and very low delay," 5 pp. Available online Jul. 22, 2011 at http://jmvalin.ca/papers/celt_eusipco2009.pdf.

Valin, J-M. et al., "A High-Quality Speech and Audio Codec With Less Than 10 ms Delay," 10 pp., Available online Jul. 22, 2011 at http://jmvalin.ca/papers/celt_tasl.pdf, (published in IEEE Transactions on Audio, Speech, and Language Processing, vol. 18, No. 1, 2010, pp. 58-67).

Etemoglu, et al., "Structured Vector Quantization Using Linear Transforms," IEEE Transactions on Signal Processing, vol. 51, No. 6, Jun. 2003, pp. 1625-1631.

Pisczalski M., et al .,"Predicting Musical Pitch from Component Frequency Ratios", Acoustical Society of America, vol. 66, Issue 3, 1979, pp. 710-720.

* cited by examiner

FIG. 3A $$\begin{bmatrix} & \\ -S[2:N] & I^{(N-1)\times(N-1)} - \frac{S[2:N]S^T[2:N]}{(1+S[1])} \end{bmatrix} \begin{bmatrix} S^T \\ \end{bmatrix}$$

FIG. 3B $$\begin{bmatrix} & \\ S[2:N] & I^{(N-1)\times(N-1)} - \frac{S[2:N]S^T[2:N]}{(1-S[1])} \end{bmatrix} \begin{bmatrix} -S^T \\ \end{bmatrix}$$

$$\begin{bmatrix} I^{(N-1)\times(N-1)} - \frac{S[1:N-1]S^T[1:N-1]}{(1+S[N])} & -S[1:N-1] \\ S^T & \end{bmatrix}$$

FIG. 5A $$\begin{bmatrix} I^{(N-1)\times(N-1)} - \frac{S[1:N-1]S^T[1:N-1]}{(1-S[N])} & S[1:N-1] \\ -S^T & \end{bmatrix}$$

FIG. 5B $$\begin{bmatrix} \begin{bmatrix} I^{(d-1)x(d-1)} - \left(\frac{S[1:d-1]S^T[1:d-1]}{(1+S[d])}\right) \end{bmatrix} \begin{bmatrix} -S[1:d-1] \end{bmatrix} \begin{bmatrix} \frac{-S[1:d-1]S^T[d+1:N]}{(1+S[d])} \end{bmatrix} \\ \begin{bmatrix} S^T \end{bmatrix} \\ \begin{bmatrix} \frac{-S[d+1:N]S^T[1:d-1]}{(1+S[d])} \end{bmatrix} \begin{bmatrix} -S[d+1:N] \end{bmatrix} \begin{bmatrix} I^{(N-d)x(N-d)} - \left(\frac{S[d+1:N]S^T[d+1:N]}{(1+S[d])}\right) \end{bmatrix} \end{bmatrix}$$

FIG. 6

SYSTEMS, METHODS, APPARATUS, AND COMPUTER-READABLE MEDIA FOR MULTI-STAGE SHAPE VECTOR QUANTIZATION

CLAIM OF PRIORITY UNDER 35 U.S.C. §119

The present Application for Patent claims priority to Provisional Application No. 61/369,662, entitled "SYSTEMS, METHODS, APPARATUS, AND COMPUTER-READABLE MEDIA FOR EFFICIENT TRANSFORM-DOMAIN CODING OF AUDIO SIGNALS," filed Jul. 30, 2010. The present Application for Patent claims priority to Provisional Application No. 61/369,705, entitled "SYSTEMS, METHODS, APPARATUS, AND COMPUTER-READABLE MEDIA FOR DYNAMIC BIT ALLOCATION," filed Jul. 31, 2010. The present Application for Patent claims priority to Provisional Application No. 61/369,751, entitled "SYSTEMS, METHODS, APPARATUS, AND COMPUTER-READABLE MEDIA FOR MULTI-STAGE SHAPE VECTOR QUANTIZATION," filed Aug. 1, 2010. The present Application for Patent claims priority to Provisional Application No. 61/374,565, entitled "SYSTEMS, METHODS, APPARATUS, AND COMPUTER-READABLE MEDIA FOR GENERALIZED AUDIO CODING," filed Aug. 17, 2010. The present Application for Patent claims priority to Provisional Application No. 61/384,237, entitled "SYSTEMS, METHODS, APPARATUS, AND COMPUTER-READABLE MEDIA FOR GENERALIZED AUDIO CODING," filed Sep. 17, 2010. The present Application for Patent claims priority to Provisional Application No. 61/470,438, entitled "SYSTEMS, METHODS, APPARATUS, AND COMPUTER-READABLE MEDIA FOR DYNAMIC BIT ALLOCATION," filed Mar. 31, 2011.

BACKGROUND

1. Field

This disclosure relates to the field of audio signal processing.

2. Background

Coding schemes based on the modified discrete cosine transform (MDCT) are typically used for coding generalized audio signals, which may include speech and/or non-speech content, such as music. Examples of existing audio codecs that use MDCT coding include MPEG-1 Audio Layer 3 (MP3), Dolby Digital (Dolby Labs., London, UK; also called AC-3 and standardized as ATSC A/52), Vorbis (Xiph.Org Foundation, Somerville, Mass.), Windows Media Audio (WMA, Microsoft Corp., Redmond, Wash.), Adaptive Transform Acoustic Coding (ATRAC, Sony Corp., Tokyo, JP), and Advanced Audio Coding (AAC, as standardized most recently in ISO/IEC 14496-3:2009). MDCT coding is also a component of some telecommunications standards, such as Enhanced Variable Rate Codec (EVRC, as standardized in 3rd Generation Partnership Project 2 (3GPP2) document C.S0014-D v2.0, Jan. 25, 2010). The G.718 codec ("Frame error robust narrowband and wideband embedded variable bit-rate coding of speech and audio from 8-32 kbit/s," Telecommunication Standardization Sector (ITU-T), Geneva, CH, June 2008, corrected November 2008 and August 2009, amended March 2009 and March 2010) is one example of a multi-layer codec that uses MDCT coding.

SUMMARY

A method of vector quantization according to a general configuration includes quantizing a first input vector that has a first direction by selecting a corresponding one among a plurality of first codebook vectors of a first codebook, and generating a rotation matrix that is based on the selected first codebook vector. This method also includes calculating a product of (A) a vector that has the first direction and (B) the rotation matrix to produce a rotated vector that has a second direction that is different than the first direction, and quantizing a second input vector that has the second direction by selecting a corresponding one among a plurality of second codebook vectors of a second codebook. Corresponding methods of vector dequantization are also disclosed. Computer-readable storage media (e.g., non-transitory media) having tangible features that cause a machine reading the features to perform such a method are also disclosed.

An apparatus for vector quantization according to a general configuration includes a first vector quantizer configured to receive a first input vector that has a first direction and to select a corresponding one among a plurality of first codebook vectors of a first codebook, and a rotation matrix generator configured to generate a rotation matrix that is based on the selected first codebook vector. This apparatus also includes a multiplier configured to calculate a product of (A) a vector that has the first direction and (B) the rotation matrix to produce a rotated vector that has a second direction that is different than the first direction, and a second vector quantizer configured to receive a second input vector that has the second direction and to select a corresponding one among a plurality of second codebook vectors of a second codebook. Corresponding apparatus for vector dequantization are also disclosed.

An apparatus for processing frames of an audio signal according to another general configuration includes means for quantizing a first input vector that has a first direction by selecting a corresponding one among a plurality of first codebook vectors of a first codebook, and means for generating a rotation matrix that is based on the selected first codebook vector. This apparatus also includes means for calculating a product of (A) a vector that has the first direction and (B) the rotation matrix to produce a rotated vector that has a second direction that is different than the first direction, and means for quantizing a second input vector that has the second direction by selecting a corresponding one among a plurality of second codebook vectors of a second codebook. Corresponding apparatus for vector dequantization are also disclosed.

BRIEF DESCRIPTION OF THE DRAWINGS

FIGS. 3A and 3B show examples of formulas that may be used to produce a rotation matrix.

FIGS. 5A, 5B, and 6 show examples of formulas that may be used to produce a rotation matrix.

DETAILED DESCRIPTION

Figure 1A:
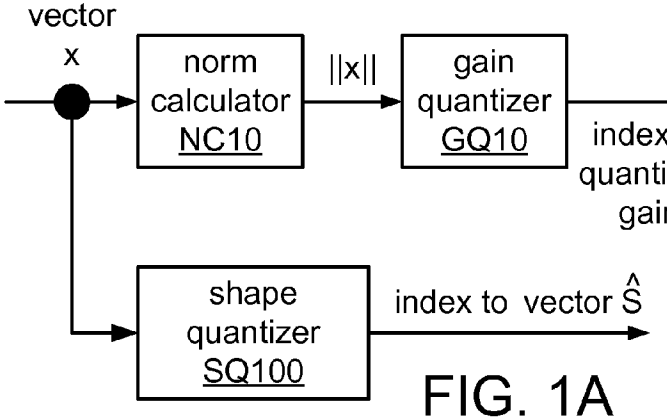
FIGS. 1A-1D show examples of gain-shape vector quantization operations.

In a gain-shape vector quantization scheme, it may be desirable to perform coding of shape vectors in multiple stages (e.g., to reduce complexity and storage). A multistage shape vector quantizer architecture as described herein may be used in such cases to support effective gain-shape vector quantization for a vast range of bitrates.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The systems, methods, and apparatus described herein are generally applicable to coding representations of audio signals in a frequency domain. A typical example of such a representation is a series of transform coefficients in a transform domain. Examples of suitable transforms include discrete orthogonal transforms, such as sinusoidal unitary transforms. Examples of suitable sinusoidal unitary transforms include the discrete trigonometric transforms, which include without limitation discrete cosine transforms (DCTs), discrete sine transforms (DSTs), and the discrete Fourier transform (DFT). Other examples of suitable transforms include lapped versions of such transforms. A particular example of a suitable transform is the modified DCT (MDCT) introduced above.

Reference is made throughout this disclosure to a "lowband" and a "highband" (equivalently, "upper band") of an audio frequency range, and to the particular example of a lowband of zero to four kilohertz (kHz) and a highband of 3.5 to seven kHz. It is expressly noted that the principles discussed herein are not limited to this particular example in any way, unless such a limit is explicitly stated. Other examples (again without limitation) of frequency ranges to which the application of these principles of encoding, decoding, allocation, quantization, and/or other processing is expressly contemplated and hereby disclosed include a lowband having a lower bound at any of 0, 25, 50, 100, 150, and 200 Hz and an upper bound at any of 3000, 3500, 4000, and 4500 Hz, and a highband having a lower bound at any of 3000, 3500, 4000, 4500, and 5000 Hz and an upper bound at any of 6000, 6500, 7000, 7500, 8000, 8500, and 9000 Hz. The application of such principles (again without limitation) to a highband having a lower bound at any of 3000, 3500, 4000, 4500, 5000, 5500, 6000, 6500, 7000, 7500, 8000, 8500, and 9000 Hz and an upper bound at any of 10, 10.5, 11, 11.5, 12, 12.5, 13, 13.5, 14, 14.5, 15, 15.5, and 16 kHz is also expressly contemplated and hereby disclosed. It is also expressly noted that although a highband signal will typically be converted to a lower sampling rate at an earlier stage of the coding process (e.g., via resampling and/or decimation), it remains a highband signal and the information it carries continues to represent the highband audio-frequency range.

A coding scheme that includes a multistage shape quantization operation as described herein may be applied to code any audio signal (e.g., including speech). Alternatively, it may be desirable to use such a coding scheme only for non-speech audio (e.g., music). In such case, the coding scheme may be used with a classification scheme to determine the type of content of each frame of the audio signal and select a suitable coding scheme.

A coding scheme that includes a multistage shape quantization operation as described herein may be used as a primary codec or as a layer or stage in a multi-layer or multi-stage codec. In one such example, such a coding scheme is used to code a portion of the frequency content of an audio signal (e.g., a lowband or a highband), and another coding scheme is used to code another portion of the frequency content of the signal. In another such example, such a coding scheme is used to code a residual (i.e., an error between the original and encoded signals) of another coding layer.

Gain-shape vector quantization is a coding technique that may be used to efficiently encode signal vectors (e.g., representing sound or image data) by decoupling the vector energy, which is represented by a gain factor, from the vector direction, which is represented by a shape. Such a technique may be especially suitable for applications in which the dynamic range of the signal may be large, such as coding of audio signals such as speech and/or music.

A gain-shape vector quantizer (GSVQ) encodes the shape and gain of an input vector x separately. FIG. 1A shows an example of a gain-shape vector quantization operation. In this example, shape quantizer SQ100 is configured to perform a vector quantization (VQ) scheme by selecting the quantized shape vector $\hat{S}$ from a codebook as the closest vector in the codebook to input vector x (e.g., closest in a mean-square-error sense) and outputting the index to vector $\hat{S}$ in the codebook. In another example, shape quantizer SQ100 is configured to perform a pulse-coding quantization scheme by selecting a unit-norm pattern of unit pulses that is closest to input vector x (e.g., closest in a mean-square-error sense) and outputting a codebook index to that pattern. Norm calculator NC10 is configured to calculate the norm $\|x\|$ of input vector x, and gain quantizer GQ10 is configured to quantize the norm to produce a quantized gain value.

Shape quantizer SQ100 is typically implemented as a vector quantizer with the constraint that the codebook vectors have unit norm (i.e., are all points on the unit hypersphere). This constraint simplifies the codebook search (e.g., from a mean-squared error calculation to an inner product operation). For example, shape quantizer SQ100 may be configured to select vector $\hat{S}$ from among a codebook of K unit-norm vectors $S_k$, k=0, 1, . . . , K−1, according to an operation such as $\arg\max_k(x^T S_k)$. Such a search may be exhaustive or optimized. For example, the vectors may be arranged within the codebook to support a particular search strategy.

Figure 1B:
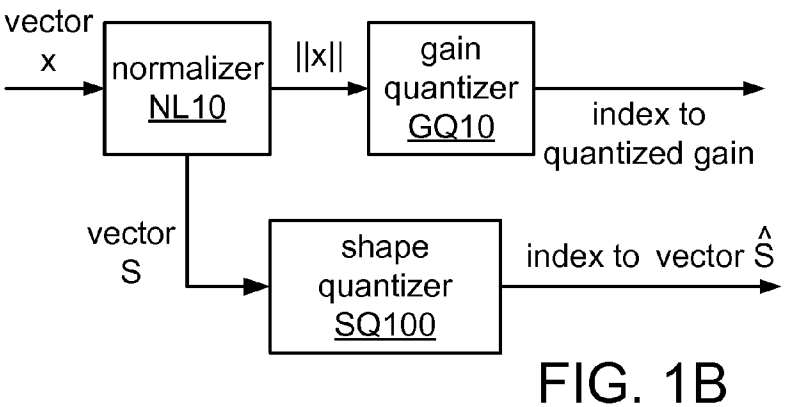

In some cases, it may be desirable to constrain the input to shape quantizer SQ100 to be unit-norm (e.g., to enable a particular codebook search strategy). FIG. 1B shows such an example of a gain-shape vector quantization operation. In this example, normalizer NL10 is configured to normalize input vector x to produce vector norm $\|x\|$ and a unit-norm shape vector $S=x/\|x\|$, and shape quantizer SQ100 is arranged to receive shape vector S as its input. In such case, shape quantizer SQ100 may be configured to select vector $\hat{S}$ from among a codebook of K unit-norm vectors $S_k$, k=0, 1, . . . , K−1, according to an operation such as $\arg\max_k(S^T S_k)$.

Alternatively, shape quantizer SQ100 may be configured to select vector $\hat{S}$ from among a codebook of patterns of unit pulses. In this case, quantizer SQ100 may be configured to select the pattern that, when normalized, is closest to shape vector S (e.g., closest in a mean-square-error sense). Such a pattern is typically encoded as a codebook index that indicates the number of pulses and the sign for each occupied position in the pattern. Selecting the pattern may include scaling the input vector and matching it to the pattern, and quantized vector $\hat{S}$ is generated by normalizing the selected pattern. Examples of pulse coding schemes that may be performed by shape quantizer SQ100 to encode such patterns include factorial pulse coding and combinatorial pulse coding.

Figure 1C:
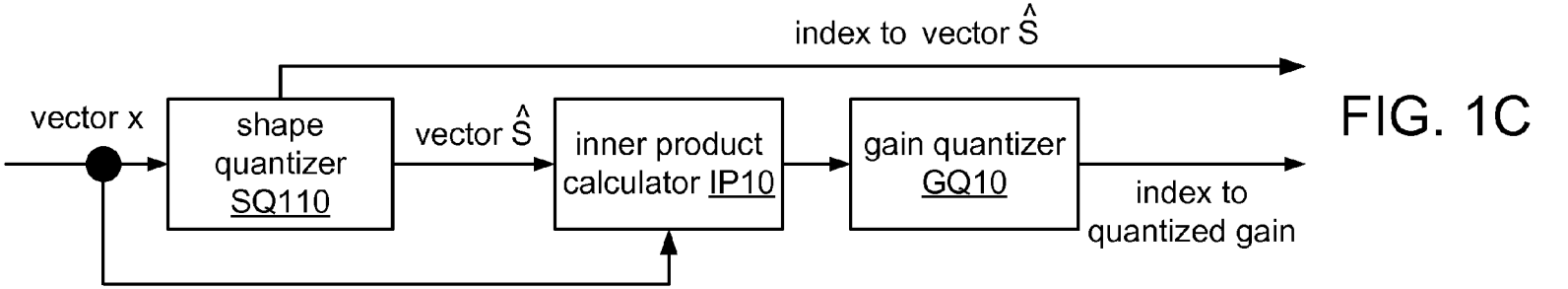
Figure 1D:
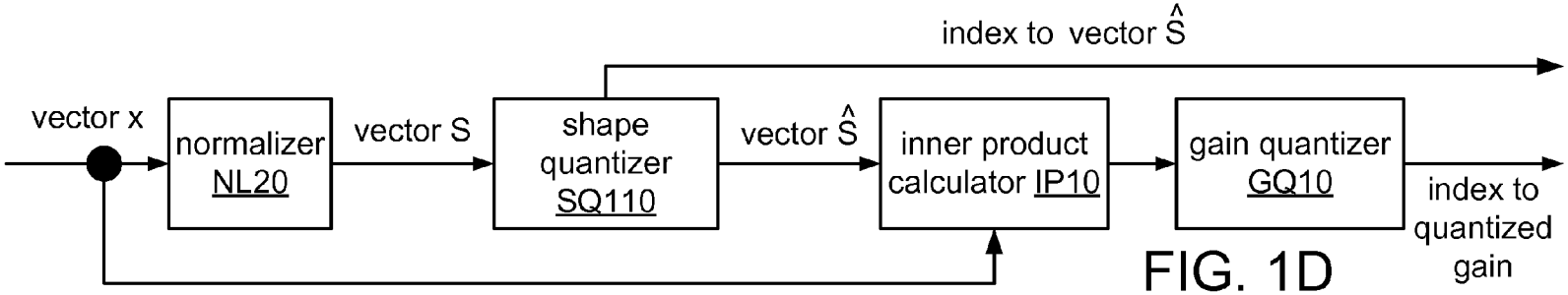

Gain quantizer GQ10 may be configured to perform scalar quantization of the gain or to combine the gain with other gains into a gain vector for vector quantization. In the example of FIGS. 1A and 1B, gain quantizer GQ10 is arranged to receive and quantize the gain of input vector x as the norm $\|x\|$ (also called the "open-loop gain"). In other cases, the gain is based on a correlation of the quantized shape vector $\hat{S}$ with the original shape. Such a gain is called a "closed-loop gain." FIG. 1C shows an example of such a gain-shape vector quantization operation that includes an inner product calculator IP10 and an implementation SQ110 of shape quantizer SQ100 that also produces the quantized shape vector $\hat{S}$. Calculator IP10 is arranged to calculate the inner product of the quantized shape vector $\hat{S}$ and the original input vector (e.g., $\hat{S}^T x$), and gain quantizer GQ10 is arranged to receive and quantize this product as the closed-loop gain. To the extent that shape quantizer SQ110 produces a poor shape quantization result, the closed-loop gain will be lower. To the extent that the shape quantizer accurately quantizes the shape, the closed-loop gain will be higher. When the shape quantization is perfect, the closed-loop gain is equal to the open-loop gain. FIG. 1D shows an example of a similar gain-shape vector quantization operation that includes a normalizer NL20 configured to normalize input vector x to produce a unit-norm shape vector $S=x/\|x\|$ as input to shape quantizer SQ110.

In audio signals, such as music and speech, signal vectors may be formed by transforming a frame of a signal into a transform domain (e.g., a fast Fourier transform (FFT) or MDCT domain) and forming subbands from these transform domain coefficients. In one example, an encoder is configured to encode a frame by dividing the transform coefficients into a set of subbands according to a predetermined division scheme (i.e., a fixed division scheme that is known to the decoder before the frame is received) and encoding each subband using a vector quantization (VQ) scheme (e.g., a GSVQ scheme as described herein). For such a case, the shape codebook may be selected to represent a division of the unit hypersphere into uniform quantization cells (e.g., Voronoi regions).

Figure 16:
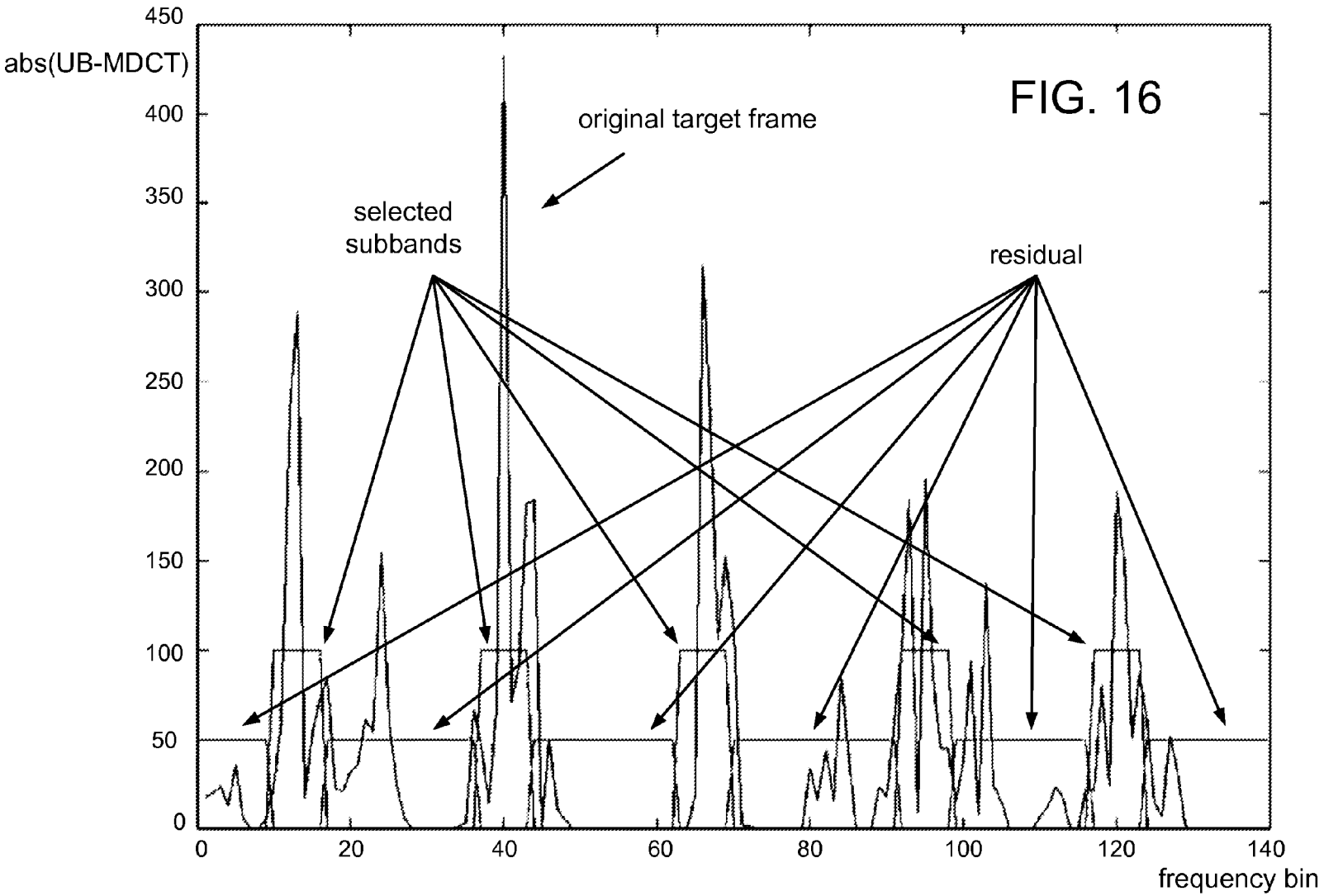
FIG. 16 shows a plot of magnitude vs. frequency for an example in which a UB-MDCT signal is being modeled.

In another example, it may be desirable to identify regions of significant energy within a signal and to encode these regions separately from the rest of the signal. For example, it may be desirable to increase coding efficiency by using relatively more bits to encode such regions and relatively fewer bits (or even no bits) to encode other regions of the signal. Such regions may generally share a particular type of shape, such that the shapes of the corresponding vectors are more likely to fall within some regions of the unit hypersphere than others. The significant regions of a signal with high harmonic content, for example, may be selected to have a peak-centered shape. FIG. 16 shows an example of such a selection for a frame of 140 MDCT coefficients of a highband portion (e.g., representing audio content in the range of 3.5 to 7 kHz) of a linear prediction coding residual signal that shows a division of the frame into the selected subbands and a residual of this selection operation. In such cases, it may be desirable to design the shape codebook to represent a division of the unit hypersphere into nonuniform quantization cells.

A multistage vector quantization scheme produces a more accurate result by encoding the quantization error of the previous stage, so that this error may be reduced at the decoder. It may be desirable to implement multistage VQ in a gain-shape VQ context.

As noted above, a shape quantizer is typically implemented as a vector quantizer with the constraint that the codebook vectors have unit norm. However, the quantization error of a shape quantizer (i.e., the difference between the input vector x and the corresponding selected codebook vector) would not be expected to have unit norm, which creates scalability issues and makes implementation of a multi-stage shape quantizer problematic. In order to obtain a useful result at the decoder, for example, encoding of both the shape and the gain of the quantization error vector would typically be required. Encoding of the error gain creates additional information to be transmitted, which may be undesirable in a bit-constrained context (e.g., cellular telephony, satellite communications).

Figure 2A:
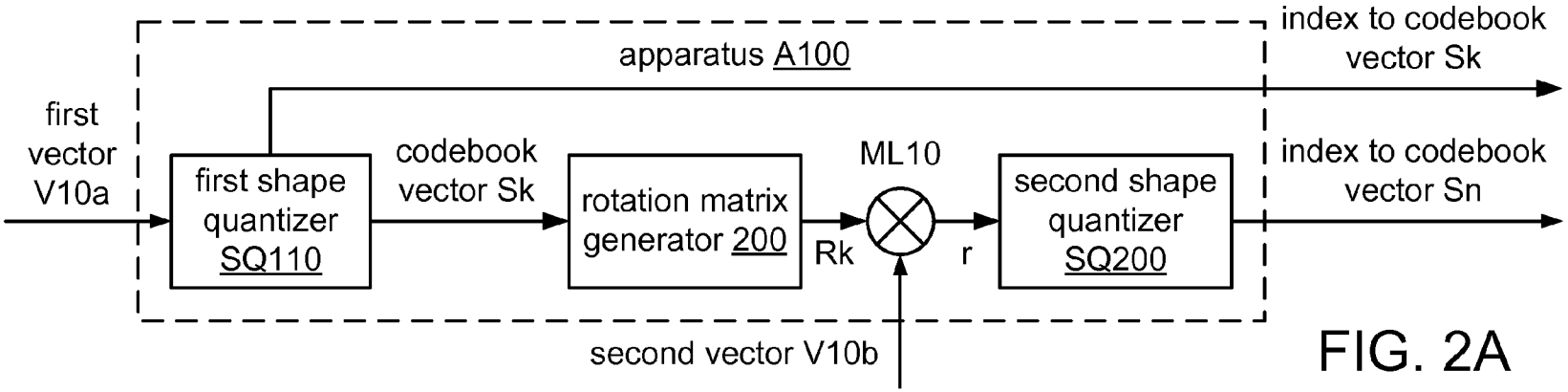
FIG. 2A shows a block diagram of an apparatus A100 for multi-stage shape quantization according to a general configuration.

FIG. 2A shows a block diagram of an apparatus A100 for multi-stage shape quantization according to a general configuration which avoids quantization of the error gain. Apparatus A100 includes an instance of shape quantizer SQ110 and an instance SQ200 of shape quantizer SQ100 as described above. First shape quantizer SQ110 is configured to quantize the shape (e.g., the direction) of a first input vector V10*a* to produce a first codebook vector Sk of length N and an index to Sk. Apparatus A100 also includes a rotation matrix generator 200 that is configured to generate an N×N rotation matrix Rk that is based on selected vector Sk, and a multiplier ML10 that is configured to calculate a product of the rotation matrix Rk and a second vector V10*b* to produce a vector r=(Rk)v (where v denotes vector V10*b*). Vector V10*b* has the same direction as vector V10*a* (for example, vectors V10*a* and V10*b* may be the same vector, or one may be a normalized version of the other), and vector r has a different direction than vectors V10*a* and V10*b*. Second shape quantizer SQ200 is configured to quantize the shape (e.g., the direction) of vector r (or of a vector that has the same direction as vector r) to produce a second codebook vector Sn and an index to Sn. (It is noted that in a general case, second shape quantizer SQ200 may be configured to receive as input a vector that is not vector r but has the same direction as vector r.)

In this approach, encoding the error for each first-stage quantization performed by first shape quantizer SQ110 includes rotating the direction of the corresponding input vector by a rotation matrix Rk that is based on (A) the first-stage codebook vector Sk which was selected to represent the input vector and (B) a reference direction. The reference direction is known to the decoder and may be fixed. The reference direction may also be independent of input vector V10*a*.

It may be desirable to configure rotation matrix generator 200 to use a formula that produces the desired rotation while minimizing any other effect on vector V10*b*. FIG. 3A shows one example of a formula that may be used by rotation matrix generator 200 to produce rotation matrix Rk by substituting the current selected vector Sk (as a column vector of length N) for S in the formula. In this example, the reference direction is that of the unit vector [1, 0, 0, . . . , 0], but any other reference direction may be selected. Potential advantages of such a reference direction include that for each input vector, the corresponding rotation matrix may be calculated relatively inexpensively from the corresponding codebook vector, and that the corresponding rotations may be performed relatively inexpensively and with little other effect, which may be especially important for fixed-point implementations.

Multiplier ML10 is arranged to calculate the matrix-vector product r=Rk×v. This unit-norm vector is the input to the second shape quantization stage (i.e., second shape quantizer SQ200). Constructing each rotation matrix based on the same reference direction causes a concentration of the quantization errors with respect to that direction, which supports effective second-stage quantization of that error.

Figure 2B:
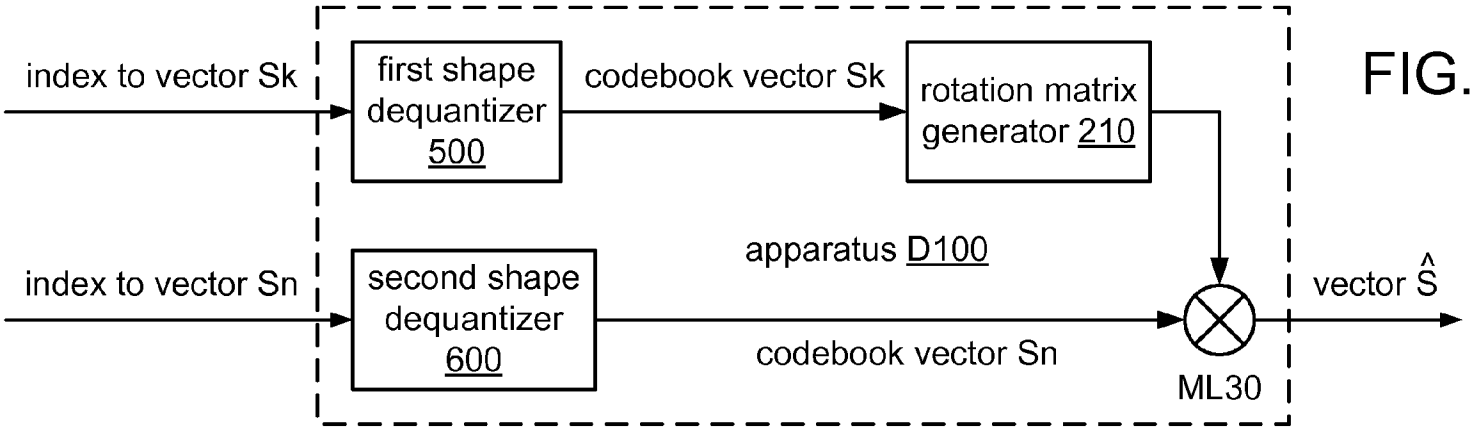
FIG. 2B shows a block diagram of an apparatus D100 for multi-stage shape dequantization according to a general configuration.

The rotation induced by rotation matrix Rk is invertible (within the bounds of computational error), such that it can be reversed by multiplication with the transpose of the rotation matrix. FIG. 2B shows a block diagram of an apparatus D100 for multi-stage shape dequantization according to a general configuration. Apparatus D100 includes a first shape dequantizer 500 that is configured to produce first selected codebook vector Sk in response to the index to vector Sk and a second shape dequantizer 600 that is configured to produce second selected codebook vector Sn in response to the index to vector Sn. Apparatus D100 also includes a rotation matrix generator 210 that is configured to generate a rotation matrix $Rk^T$, based on the first-stage codebook vector Sk, that is the transpose of the corresponding rotation matrix generated at the encoder (e.g., by generator 200). For example, generator 210 may be implemented to generate a matrix according to the same formula as generator 200 and then calculate a transpose of that matrix (e.g., by reflecting it over its main diagonal), or to use a generative formula that is the transpose of that formula. Apparatus D100 also includes a multiplier ML30 that calculates the output vector $\hat{S}$ as the matrix-vector product $Rk^T \times Sn$.

Figure 4:
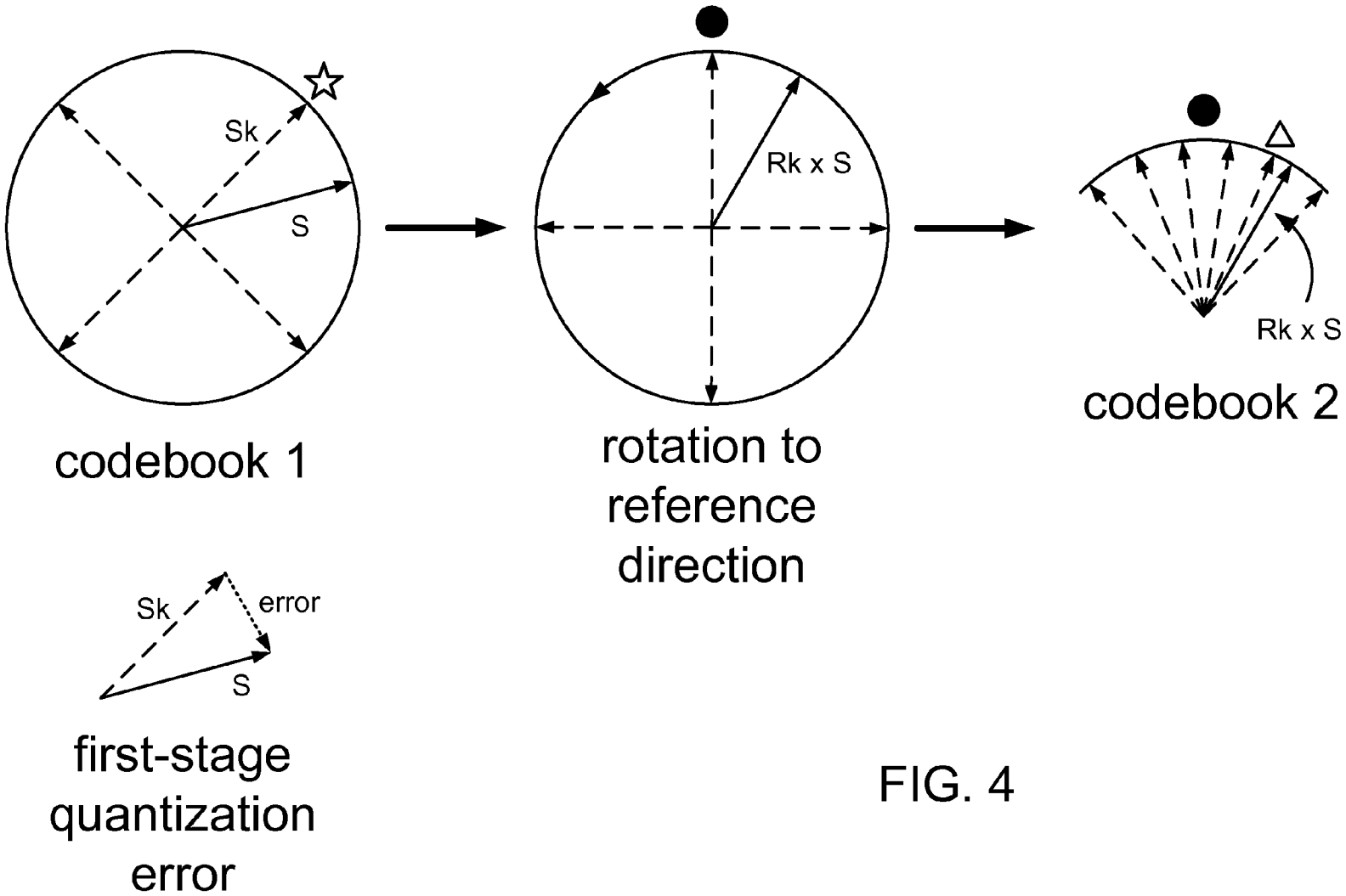
FIG. 4 illustrates principles of operation of apparatus A100 using a simple two-dimensional example.

FIG. 4 illustrates principles of operation of apparatus A100 using a simple two-dimensional example. On the left side, a unit-norm vector S is quantized in a first stage by selecting the closest Sk (indicated by the star) among a set of codebook vectors (indicated as dashed arrows). The codebook search may be performed using an inner product operation (e.g., by selecting the codebook vector whose inner product with vector S is minimum). The codebook vectors may be distributed uniformly around the unit hypersphere (e.g., as shown in FIG. 4) or may be distributed nonuniformly as noted herein.

As shown in the lower left of FIG. 4, using a vector subtraction to determine the quantization error of the first stage produces an error vector that is no longer unit-norm. Instead, the vector S is rotated as shown in the center of FIG. 4 by a rotation matrix Rk that is based on codebook vector Sk as described herein. For example, rotation matrix Rk may be selected as a matrix that would rotate codebook vector Sk to a specified reference direction (indicated by the dot). The right side of FIG. 4 illustrates a second quantization stage, in which the rotated vector Rk×S is quantized by selecting the vector from a second codebook that is closest to Rk×S (e.g., that has the minimum inner product with the vector Rk×S), as indicated by the triangle. As shown in FIG. 4, the rotation operation concentrates the first-stage quantization error around the reference direction, such that the second codebook may cover less than the entire unit hypersphere.

For a case in which S[1] is close to negative one, the generative formula in FIG. 3A may involve a division by a very small number, which may present a computational problem especially in a fixed-point implementation. It may be desirable to configure rotation matrix generators 200 and 210 to use the formula in FIG. 3B instead in such a case (e.g., whenever S[1] is less than zero, such that the division will always be by a number at least equal to one). Alternatively, an equivalent effect may be obtained in such case by reflecting the rotation matrix along the first axis (e.g., the reference direction) at the encoder and reversing the reflection at the decoder.

Other choices for the reference direction may include any of the other unit vectors. For example, FIGS. 5A and 5B show examples of generative formulas that correspond to those shown in FIGS. 3A and 3B for the reference direction indicated by the length-N unit vector [0, 0, . . . , 0, 1]. FIG. 6 shows a general example of a generative formula, corresponding to the formula shown in FIG. 3A, for the reference direction indicated by the length-N unit vector whose only nonzero element is the d-th element (where 1<d<N). In general, it may be desirable for the rotation matrix Rk to define a rotation of the selected first codebook vector, within a plane that includes the selected first codebook vector and the reference vector, to the direction of the reference vector (e.g., as in the examples shown in FIGS. 3A, 3B, 4, 5A, 5B, and 6). Although vector V10*b* will generally not lie in this plane, multiplying vector V10*b* by rotation matrix Rk will rotate it within a plane that is parallel to this plane. Multiplication by rotation matrix Rk rotates a vector about a subspace (of dimension N−2) that is orthogonal to both the selected first codebook vector and the reference direction.

Figure 7A:
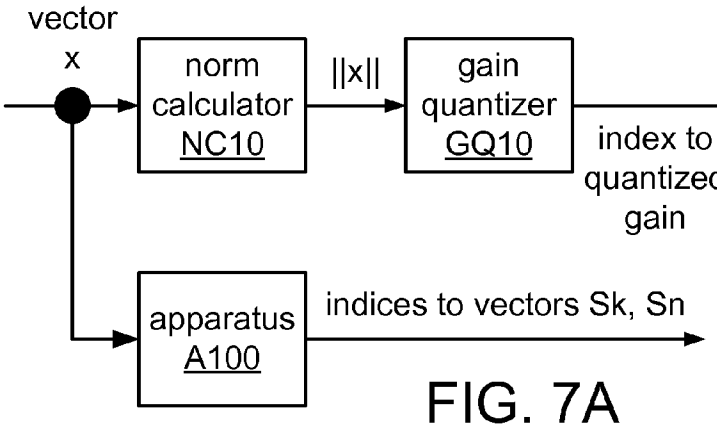
FIGS. 7A and 7B show examples of applications of apparatus A100 to the open-loop gain coding structures of FIGS. 1A and 1B, respectively.
Figure 7B:
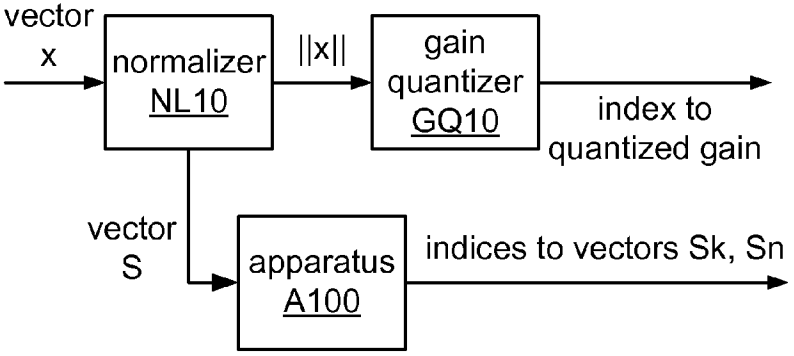

FIGS. 7A and 7B show examples of applications of apparatus A100 to the open-loop gain coding structures of FIGS. 1A and 1B, respectively. In FIG. 7A, apparatus A100 is arranged to receive vector x as input vector V10*a* and vector V10*b*, and in FIG. 7B, apparatus A100 is arranged to receive shape vector S as input vector V10*a* and vector V10*b*.

Figure 7C:
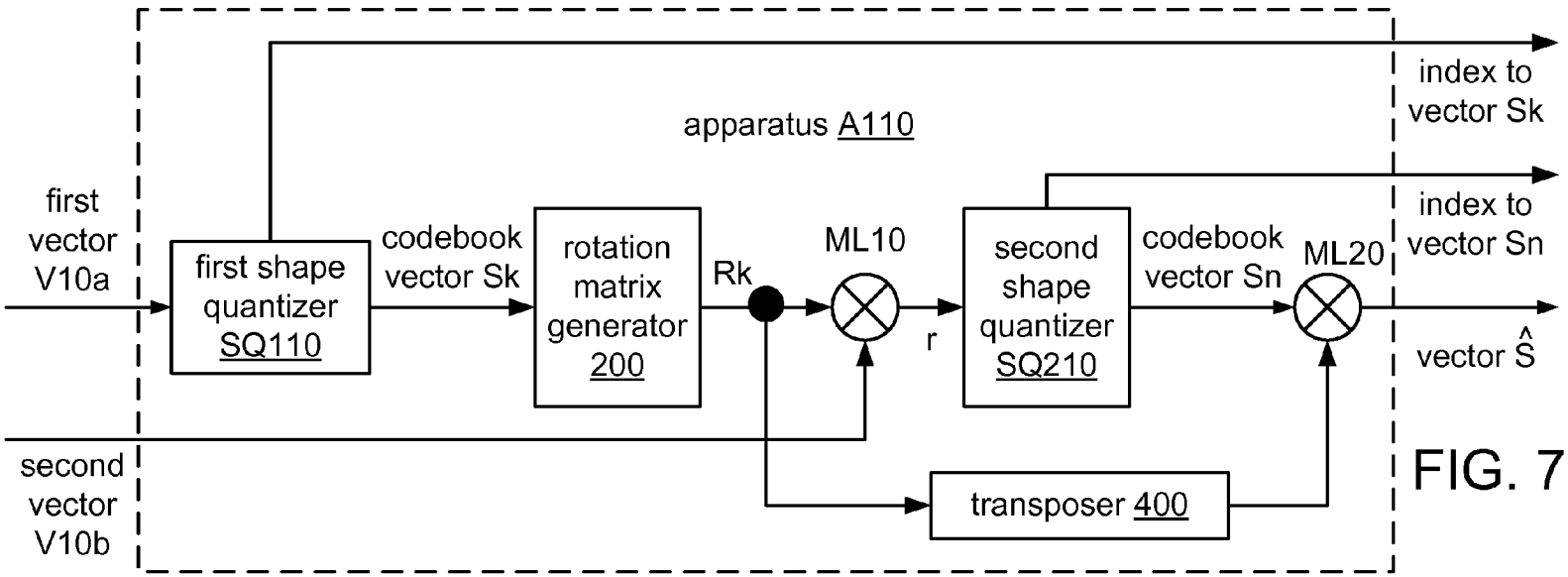
FIG. 7C shows a block diagram of an implementation A110 of apparatus A100 that may be used in a closed-loop gain coding structure.
Figure 8A:
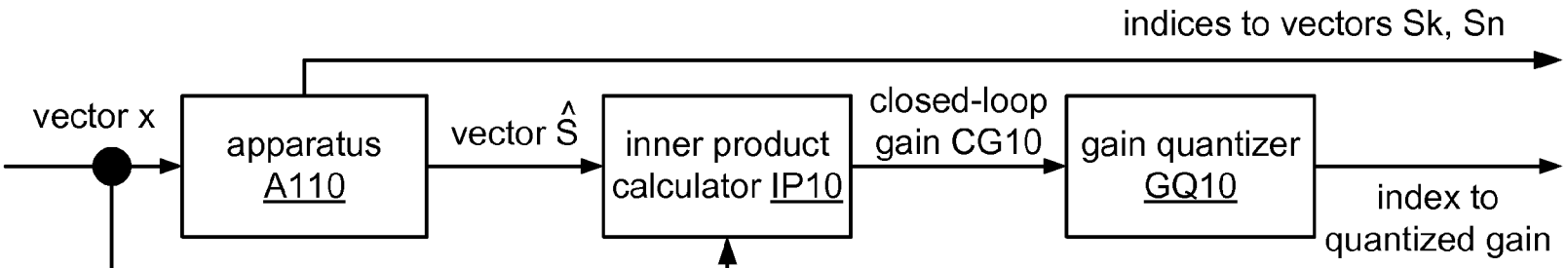
FIGS. 8A and 8B show examples of applications of apparatus A110 to the open-loop gain coding structures of FIGS. 1C and 1D, respectively.
Figure 8B:
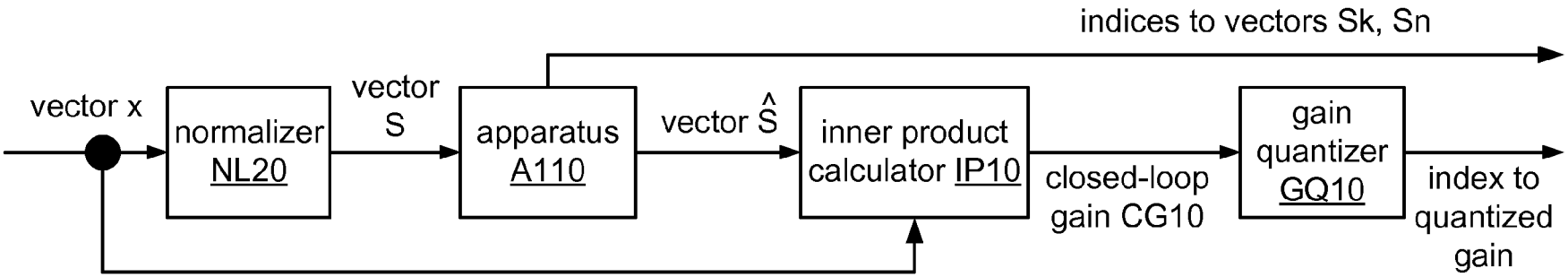

FIG. 7C shows a block diagram of an implementation A110 of apparatus A100 that may be used in a closed-loop gain coding structure (e.g., as shown in FIGS. 1C and 1D). Apparatus A110 includes a transposer 400 that is configured to calculate a transpose of rotation matrix Rk (e.g., to reflect matrix Rk about its main diagonal) and a multiplier ML20 that is configured to calculate the quantized shape vector $\hat{S}$ as the matrix-vector product $Rk^T \times Sn$. FIGS. 8A and 8B show examples of applications of apparatus A110 to the open-loop gain coding structures of FIGS. 1C and 1D, respectively.

Figure 9A:
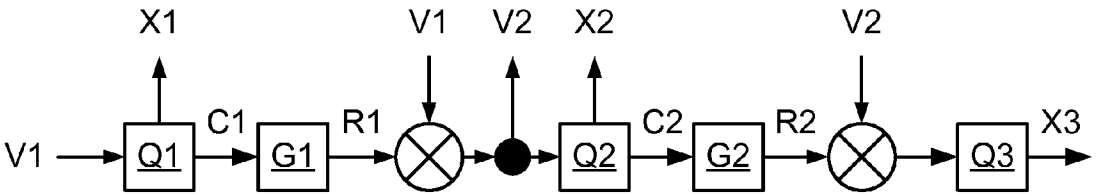
FIG. 9A shows a schematic diagram of a three-stage shape quantizer that is an extension of apparatus A100.
Figure 9B:
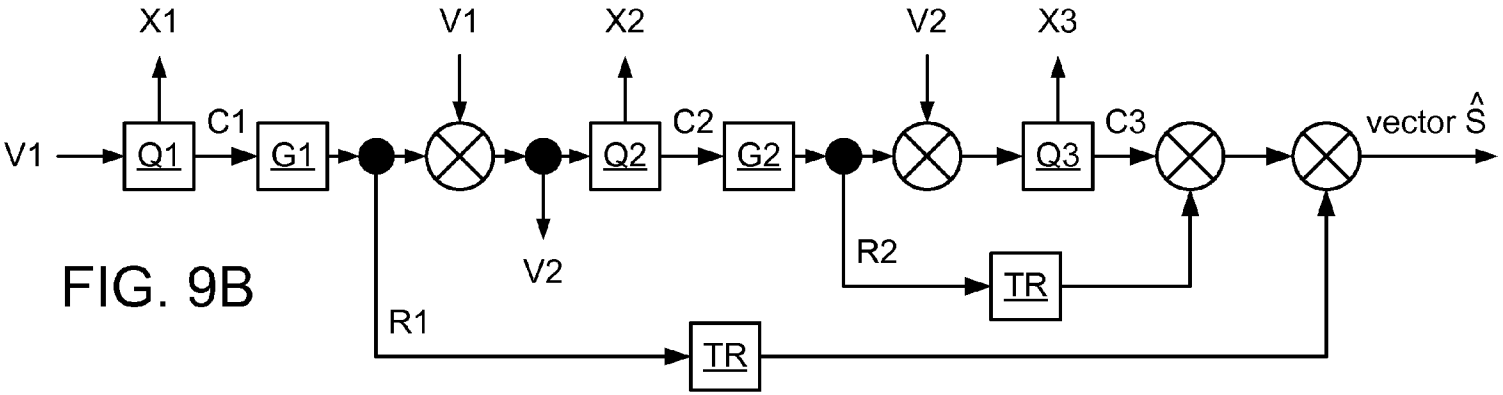
FIG. 9B shows a schematic diagram of a three-stage shape quantizer that is an extension of apparatus A110.
Figure 9C:
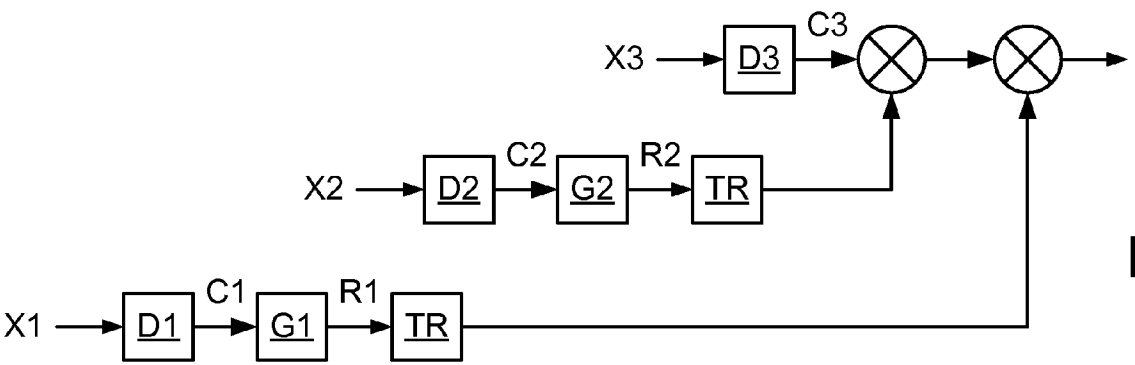
FIG. 9C shows a schematic diagram of a three-stage shape dequantizer that is an extension of apparatus D100.

The multistage shape quantization principles described herein may be extended to an arbitrary number shape quantization stages. For example, FIG. 9A shows a schematic diagram of a three-stage shape quantizer that is an extension of apparatus A100. In this figure, the various labels denote the following structures or values: vector directions V1 and V2; codebook vectors C1 and C2; codebook indices X1, X2, and X3; quantizers Q1, Q2, and Q3; rotation matrix generators G1 and G2, and rotation matrices R1 and R2. FIG. 9B shows a similar schematic diagram of a three-stage shape quantizer that is an extension of apparatus A110 and generates the quantized shape vector $\hat{S}$ (in this figure, each label TR denotes a matrix transposer). FIG. 9C shows a schematic diagram of a corresponding three-stage shape dequantizer that is an extension of apparatus D100.

Low-bit-rate coding of audio signals often demands an optimal utilization of the bits available to code the contents of the audio signal frame. The contents of the audio signal frames may be either the PCM samples of the signal or a transform-domain representation of the signal. Encoding of the signal vector typically includes dividing the vector into a plurality of subvectors, assigning a bit allocation to each subvector, and encoding each subvector into the corresponding allocated number of bits. It may be desirable in a typical audio coding application, for example, to perform gain-shape vector quantization on a large number of (e.g., ten or twenty) different subband vectors for each frame. Examples of frame size include 100, 120, 140, 160, and 180 values (e.g., transform coefficients), and examples of subband length include five, six, seven, eight, nine, ten, eleven, and twelve.

One approach to bit allocation is to split up the total bit allocation B uniformly among the different shape vectors (and use, e.g., a closed-loop gain-coding scheme). For example, the number of bits allocated to each subvector may be fixed from frame to frame. In this case, the decoder may already be configured with knowledge of the bit allocation scheme such that there is no need for the encoder to transmit this information. However, the goal of the optimum utilization of bits may be to ensure that various components of the audio signal frame are coded with a number of bits that is related (e.g., proportional) to their perceptual significance. Some of the input subband vectors may be less significant (e.g., may capture little energy), such that a better result might be obtained by allocating fewer bits to these shape vectors and more bits to the shape vectors of more important subbands.

As a fixed allocation scheme does not account for variations in the relative perceptual significance of the subvectors, it may be desirable to use a dynamic allocation scheme instead, such that the number of bits allocated to each subvector may vary from frame to frame. In this case, information regarding the particular bit allocation scheme used for each frame is supplied to the decoder so that the frame may be decoded.

Most audio encoders explicitly transmit the bit allocation as side information to the decoder. Audio coding algorithms such as AAC, for example, typically use side information or entropy coding schemes such as Huffman coding to convey the bit allocation information. Use of side information solely to convey bit allocation is inefficient, as this side information is not used directly for coding the signal. While variable-length codewords like Huffman coding or arithmetic coding may provide some advantage, one may encounter long codewords that may reduce coding efficiency. It may be desirable instead to use a dynamic bit allocation scheme that is based on coded gain parameters which are known to both the encoder and the decoder, such that the scheme may be performed without the explicit transmission of side information from the encoder to the decoder. Such efficiency may be especially important for low-bit-rate applications, such as cellular telephony.

Such a dynamic bit allocation may be implemented without side information by allocating bits for shape quantization according to the values of the associated gains. In a source-coding sense, the closed-loop gain may be considered to be more optimal, because it takes into account the particular shape quantization error, unlike the open-loop gain. However, it may be desirable to perform processing upstream based on this gain value. Specifically, it may be desirable to use the gain value to decide how to quantize the shape (e.g., to use the gain values to dynamically allocate the quantization bit-budget among the shapes). In this case, because the gain controls the bit allocation, the shape quantization explicitly depends on the gain at both the encoder and decoder, such that a shape-independent open-loop gain calculation is used rather than a shape-dependent closed-loop gain.

In order to support a dynamic allocation scheme, it may be desirable to implement the shape quantizer and dequantizers (e.g., quantizers SQ110, SQ200, SQ210; dequantizers 500 and 600) to select from among codebooks of different sizes (i.e., from among codebooks having different index lengths) in response to the particular number of bits that are allocated for each shape to be quantized. In such an example, one or more of the quantizers of apparatus A100 (e.g., quantizers SQ110 and SQ200 or SQ210) may be implemented to use a codebook having a shorter index length to encode the shape of a subband vector whose open-loop gain is low, and to use a codebook having a longer index length to encode the shape of a subband vector whose open-loop gain is high. Such a dynamic allocation scheme may be configured to use a mapping between vector gain and shape codebook index length that is fixed or otherwise deterministic such that the corresponding dequantizers may apply the same scheme without any additional side information.

In an open-loop gain-coding case, it may be desirable to configure the decoder (e.g., the gain dequantizer) to multiply the open-loop gain by a factor $\gamma$ that is a function of the number of bits that was used to encode the shape (e.g., the lengths of the indices to the shape codebook vectors). When very few bits are used to quantize the shape, the shape quantizer is likely to produce a large error such that the vectors S and $\hat{S}$ may not match very well, so it may be desirable at the decoder to reduce the gain to reflect that error. The correction factor $\gamma$ represents this error only in an average sense: it only depends on the codebook (specifically, on the number of bits in the codebooks) and not on any particular detail of the input vector x. The codec may be configured such that the correction factor $\gamma$ is not transmitted, but rather is just read out of a table by the decoder according to how many bits were used to quantize vector $\hat{S}$.

This correction factor $\gamma$ indicates, based on the bit rate, how close on average vector $\hat{S}$ may be expected to approach the true shape S. As the bit rate goes up, the average error will decrease and the value of correction factor $\gamma$ will approach one, and as the bit rate goes very low, the correlation between S and vector $\hat{S}$ (e.g., the inner product of vector $\hat{S}^T$ and S) will decrease, and the value of correction factor $\gamma$ will also decrease. While it may be desirable to obtain the same effect as in the closed-loop gain (e.g., on an actual input-by-input, adaptive sense), for the open-loop case the correction is typically available only in an average sense.

Alternatively, a sort of an interpolation between the open-loop and closed-loop gain methods may be performed. Such an approach augments the open-loop gain expression with a dynamic correction factor that is dependent on the quality of the particular shape quantization, rather than just a length-based average quantization error. Such a factor may be calculated based on the dot product of the quantized and unquantized shapes. It may be desirable to encode the value of this correction factor very coarsely (e.g., as an index into a four- or eight-entry codebook) such that it may be transmitted in very few bits.

It may be desirable to efficiently exploit correlation in the gain parameters over time and/or across frequencies. As noted above, signal vectors may be formed in audio coding by transforming a frame of a signal into a transform domain and forming subbands from these transform domain coefficients. It may be desirable to use a predictive gain coding scheme to exploit correlations among the energies of vectors from consecutive frames. Additionally or alternatively, it may be desirable to use a transform gain coding scheme to exploit correlations among the energies of subbands within a single frame.

Figure 10A:
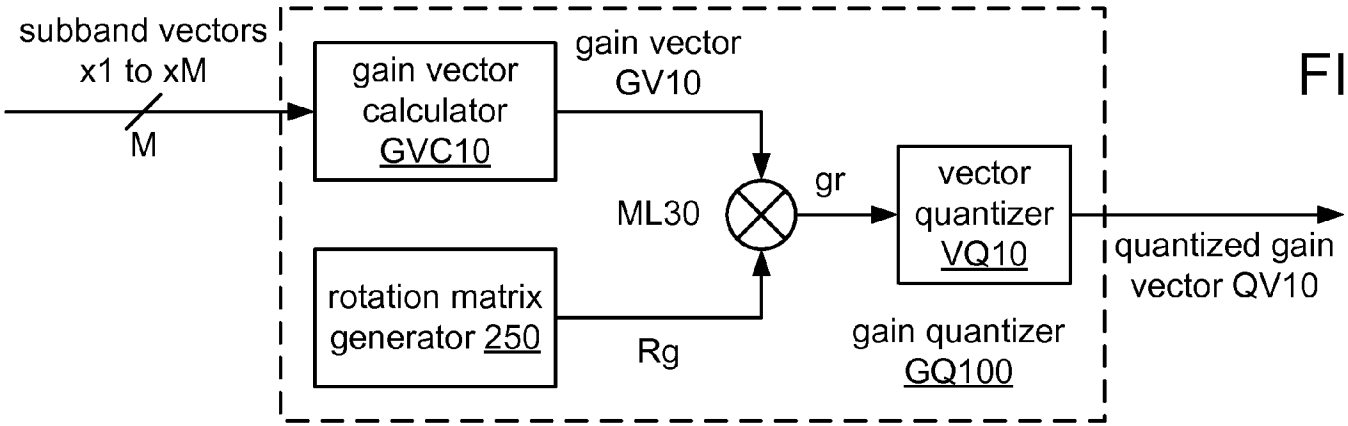
FIG. 10A shows a block diagram of an implementation GQ100 of gain quantizer GQ10.

FIG. 10A shows a block diagram of an implementation GQ100 of gain quantizer GQ10 that includes a different application of a rotation matrix as described herein. Gain quantizer GQ100 includes a gain vector calculator GVC10 that is configured to receive M subband vectors x1 to xM of a frame of an input signal and to produce a corresponding vector GV10 of subband gain values. The M subbands may include the entire frame (e.g., divided into M subbands according to a predetermined division scheme). Alternatively, the M subbands may include less than all of the frame (e.g., as selected according to a dynamic subband scheme, as in the examples noted herein). Examples of the number of subbands M include (without limitation) five, six, seven, eight, nine, ten, and twenty.

Figure 10B:
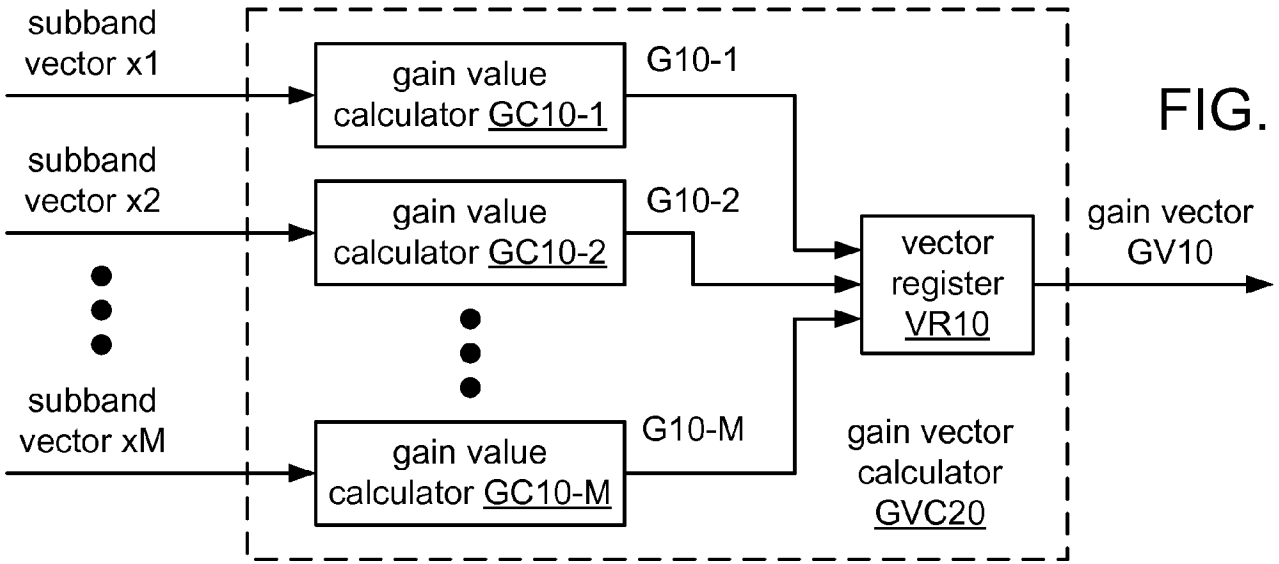
FIG. 10B shows a block diagram of an implementation GVC20 of gain vector calculator GVC10.

FIG. 10B shows a block diagram of an implementation GVC20 of gain vector calculator GVC10. Vector calculator GVC20 includes M instances GC10-1, GC10-2, . . . , GC10-M of a gain factor calculator that are each configured to calculate a corresponding gain value G10-1, G10-2, . . . , G10-M for a corresponding one of the M subbands. In one example, each gain factor calculator GC10-1, GC10-2, . . . , GC10-M is configured to calculate the corresponding gain value as a norm of the corresponding subband vector. In another example, each gain factor calculator GC10-1, GC10-2, . . . , GC10-M is configured to calculate the corresponding gain value in a decibel or other logarithmic or perceptual scale. In one such example, each gain factor calculator GC10-1, GC10-2, . . . , GC10-M is configured to calculate the corresponding gain value GC10-*m*, 1<=m<=M, according to an expression such as GC10-$m$=10 $\log_{10}\|x_m\|^2$, where $x_m$ denotes the corresponding subband vector.

Vector calculator GVC20 also includes a vector register VR10 that is configured to store each of the M gain values G10-1 to G10-M to a corresponding element of a vector of length M for the corresponding frame and to output this vector as gain vector GV10.

Gain quantizer GQ100 also includes an implementation 250 of rotation matrix generator 200 that is configured to produce a rotation matrix Rg, and a multiplier ML30 that is configured to calculate vector gr as the matrix-vector product of Rg and gain vector GV10. In one example, generator 250 is configured to generate matrix Rg by substituting the length-M unit-norm vector Y, where $Y^T=[1, 1, 1, \ldots, 1]/\sqrt{M}$, for S in the generative formula shown in FIG. 3A. The resulting rotation matrix Rg has the effect of producing an output vector gr that has the average power of the gain vector GV10 in its first element.

Although other transforms may be used to produce such a first-element average (e.g., a FFT, MDCT, Walsh, or wavelet transform), each of the other elements of the output vector gr produced by this transform is a difference between this average and the corresponding element of vector GV10. By separating the average gain value of the frame from the differences among the subband gains, such a scheme enables the bits that would have been used to encode that energy in each subband (e.g., in a loud frame) to become available to encode the fine details in each subband. These differences may also be used as input to a method for dynamic allocation of bits to corresponding shape vectors (e.g., as described herein). For a case in which it is desired to place the average power into a different element of vector gr, a corresponding one of the generative formulas described herein may be used instead.

Gain quantizer GQ100 also includes a vector quantizer VQ10 that is configured to quantize at least a subvector of the vector gr (e.g., the subvector of length M−1 that excludes the average value) to produce a quantized gain vector QV10 (e.g., as one or more codebook indices). In one example, vector quantizer VQ10 is implemented to perform split-vector quantization. For a case in which the gain values G10-1 to G10-M are open-loop gains, it may be desirable to configure the corresponding dequantizer to apply a correction factor γ as described above to the corresponding decoded gain values.

Figure 11A:
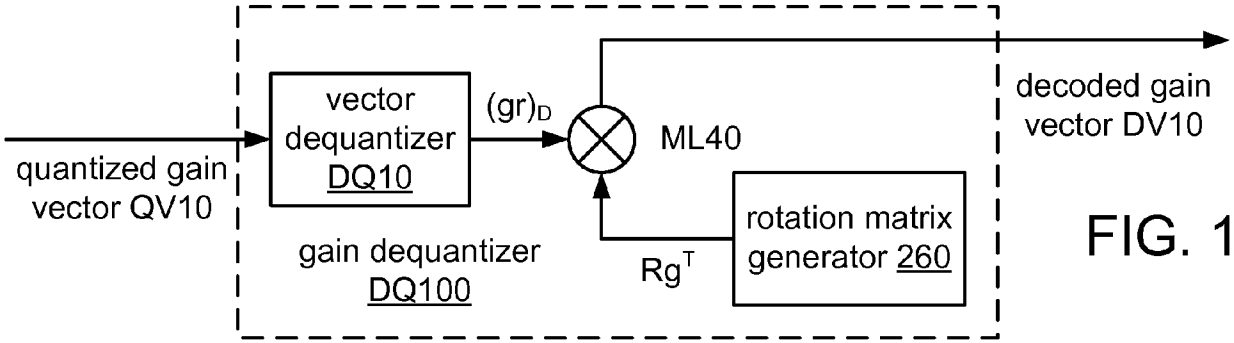
FIG. 11A shows a block diagram of a gain dequantizer DQ100.

FIG. 11A shows a block diagram of a corresponding gain dequantizer DQ100. Dequantizer DQ100 includes a vector dequantizer DQ10 configured to dequantize quantized gain vector QV10 to produce a dequantized vector $(gr)_D$, a rotation matrix generator 260 configured to generate a transpose $Rg^T$ of the rotation matrix applied in quantizer GQ100, and a multiplier ML40 configured to calculate the matrix-vector product of matrix $Rg^T$ and vector $(gr)_D$ to produce a decoded gain vector DV10. For a case in which quantized gain vector QV10 does not include the average value element of vector gr (e.g., as described herein with reference to FIG. 12A), the decoded average value may be otherwise combined with the elements of dequantized vector $(gr)_D$ to produce the corresponding elements of decoded gain vector DV10.

The gain which corresponds to the element of vector gr that is occupied by the average power may be derived (e.g., at the decoder, and possibly at the encoder for purposes of bit allocation) from the other elements of the gain vector (e.g., after dequantization). For example, this gain may be calculated as the difference between (A) the total gain implied by the average (i.e., the average times M) and (B) the sum of the other (M−1) reconstructed gains. Although such a derivation may have the effect of accumulating quantization error of the other (M−1) reconstructed gains into the derived gain value, it also avoids the expense of coding and transmitting that gain value.

It is expressly noted that gain quantizer GQ100 may be used with an implementation of multi-stage shape quantization apparatus A100 as described herein (e.g., A110) and may also be used independently of apparatus A100, as in applications of single-stage gain-shape vector quantization to sets of related subband vectors.

As noted above, a GSVQ with predictive gain encoding may be used to encode the gain factors of a set of selected (e.g., high-energy) subbands differentially from frame to frame. It may be desirable to use a gain-shape vector quantization scheme that includes predictive gain coding such that the gain factors for each subband are encoded independently from one another and differentially with respect to the corresponding gain factor of the previous frame.

Figure 11B:
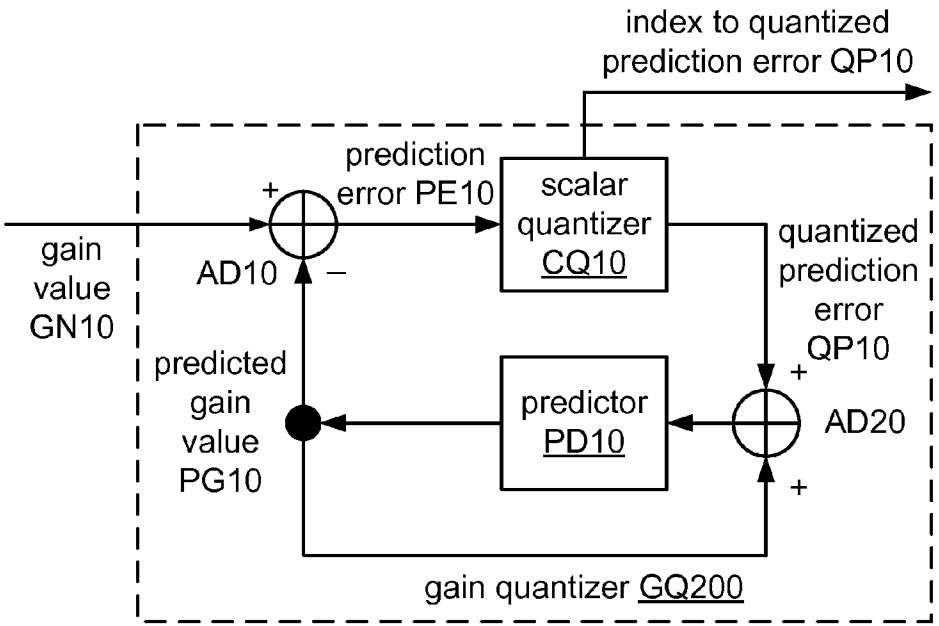
FIG. 11B shows a block diagram of a predictive implementation GQ200 of gain quantizer GQ10.
Figure 11C:
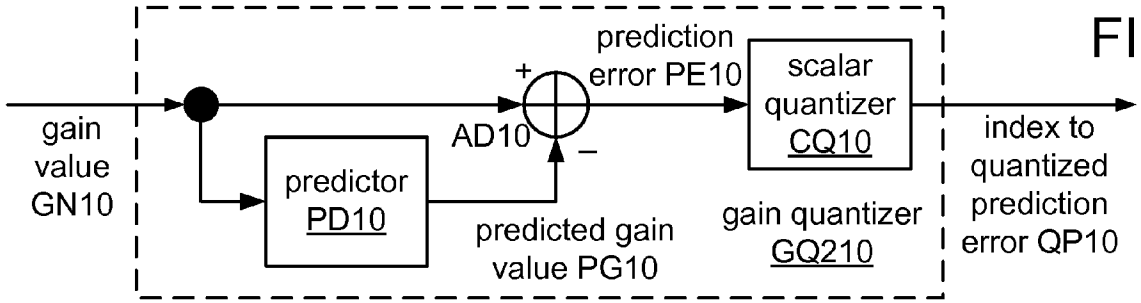
FIG. 11C shows a block diagram of a predictive implementation GQ210 of gain quantizer GQ10.
Figure 11D:
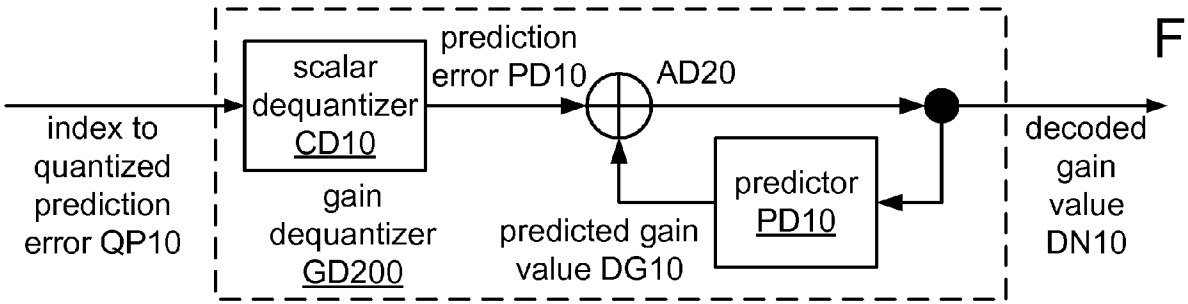
FIG. 11D shows a block diagram of gain dequantizer GD200.
Figure 11E:
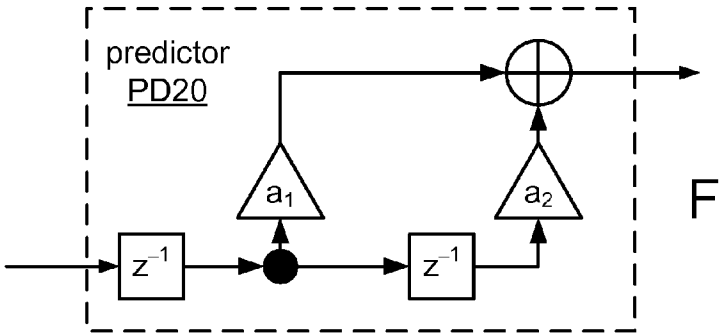
FIG. 11E shows a block diagram of an implementation PD20 of predictor PD10.

FIG. 11B shows a block diagram of a predictive implementation GQ200 of gain quantizer GQ10 that includes a scalar quantizer CQ10 configured to quantize prediction error PE10 to produce quantized prediction error QP10 and a corresponding codebook index to error QP10, an adder AD10 configured to subtract a predicted gain value PG10 from gain value GN10 to produce prediction error PE10, an adder AD20 configured to add quantized prediction error QP10 to predicted gain value PG10, and a predictor PD10 configured to calculate predicted gain value PG10 based on one or more sums of previous values of quantized prediction error QP10 and predicted gain value PG10. Predictor PD10 may be implemented as a second-order finite-impulse-response filter having a transfer function such as $H(z)=\alpha_1 z^{-1}+\alpha_2 z^{-2}$. FIG. 11E shows a block diagram of such an implementation PD20 of predictor PD10. Example coefficient values for such a filter include (a1, a2)=(0.8, 0.2). The input gain value GN10 may be an open-loop gain or a closed-loop gain as described herein. FIG. 11C shows a block diagram of another predictive implementation GQ210 of gain quantizer GQ10. In this case, it is not necessary for scalar quantizer CQ10 to output the codebook entry that corresponds to the selected index. FIG. 11D shows a block diagram of a gain dequantizer GD200 that may be used (e.g., at a corresponding decoder) to produce a decoded gain value DN10 according to a codebook index to quantized prediction error QP10 as produced by either of gain quantizers GQ200 and GQ210. Dequantizer GD200 includes a scalar dequantizer CD10 configured to produce dequantized prediction error PD10 as indicated by the codebook index, an instance of predictor PD10 arranged to produce a predicted gain value DG10 based on one or more previous values of decoded gain value DN10, and an instance of adder AD20 arranged to add predicted gain value DG10 and dequantized prediction error PD10 to produce decoded gain value DN10.

It is expressly noted that gain quantizer GQ200 or GQ210 may be used with an implementation of multi-stage shape quantization apparatus A100 as described herein (e.g., A110) and may also be used independently of apparatus A100, as in applications of single-stage gain-shape vector quantization to sets of related subband vectors. For a case in which gain value GB10 is an open-loop gain, it may be desirable to configure the corresponding dequantizer to apply a correction factor γ as described above to the corresponding decoded gain value.

Figure 12A:
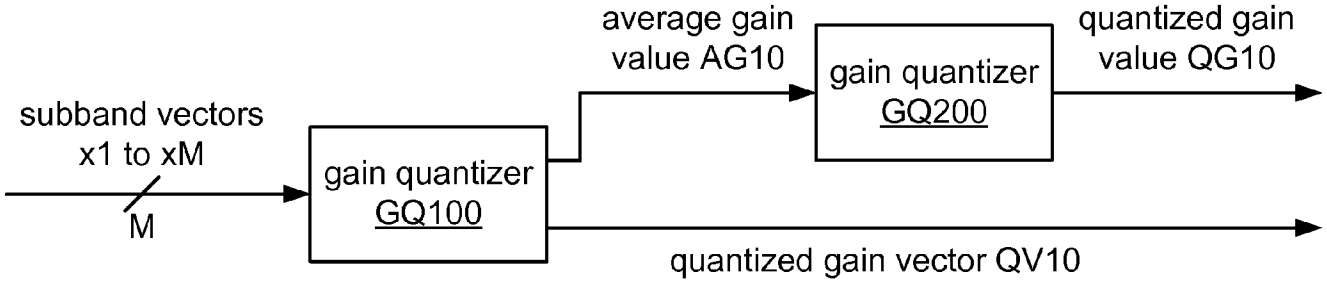
FIG. 12A shows a gain-coding structure that includes instances of gain quantizers GQ100 and GQ200.

It may be desirable to combine a predictive structure such as gain quantizer GQ200 or GQ210 with a transform structure for gain coding such as gain quantizer GQ100. FIG. 12A shows an example in which gain quantizer GQ100 is configured to quantize subband vectors x1 to xM as described herein to produce the average gain value AG10 from vector gr and a quantized gain vector QV10 based on the other (e.g., the differential) elements of vector gr. In this example, predictive gain quantizer GQ200 (alternatively, GQ210) is arranged to operate only on average gain value AG10.

It may be desirable to use an approach as shown in FIG. 12A in conjunction with a dynamic allocation method as described herein. Because the average component of the subband gains does not affect dynamic allocation among the subbands, coding the differential components without dependence on the past may be used to obtain a dynamic allocation operation that is resistant to a failure of the predictive coding operation (e.g., resulting from an erasure of the previous frame) and robust against loss of past frames. It is expressly noted that such an arrangement may be used with an implementation of multi-stage shape quantization apparatus A100 as described herein (e.g., A110) and may also be used independently of apparatus A100, as in applications of single-stage gain-shape vector quantization to sets of related subband vectors.

It is expressly contemplated and hereby disclosed that any of the shape quantization operations indicated in this disclosure may be implemented according to the multi-stage shape quantization principles described herein. An encoder that includes an implementation of apparatus A100 may be configured to process an audio signal as a series of segments. A segment (or "frame") may be a block of transform coefficients that corresponds to a time-domain segment with a length typically in the range of from about five or ten milliseconds to about forty or fifty milliseconds. The time-domain segments may be overlapping (e.g., with adjacent segments overlapping by 25% or 50%) or nonoverlapping.

It may be desirable to obtain both high quality and low delay in an audio coder. An audio coder may use a large frame size to obtain high quality, but unfortunately a large frame size typically causes a longer delay. Potential advantages of an audio encoder as described herein include high quality coding with short frame sizes (e.g., a twenty-millisecond frame size, with a ten-millisecond lookahead). In one particular example, the time-domain signal is divided into a series of twenty-millisecond nonoverlapping segments, and the MDCT for each frame is taken over a forty-millisecond window that overlaps each of the adjacent frames by ten milliseconds.

In one particular example, each of a series of segments (or "frames") processed by an encoder that includes an implementation of apparatus A100 contains a set of 160 MDCT coefficients that represent a lowband frequency range of 0 to 4 kHz (also referred to as the lowband MDCT, or LB-MDCT). In another particular example, each of a series of frames processed by such an encoder contains a set of 140 MDCT coefficients that represent a highband frequency range of 3.5 to 7 kHz (also referred to as the highband MDCT, or HB-MDCT).

An encoder that includes an implementation of apparatus A100 may be implemented to encode subbands of fixed and equal length. In a particular example, each subband has a width of seven frequency bins (e.g., 175 Hz, for a bin spacing of twenty-five Hz), such that the length of the shape of each subband vector is seven. However, it is expressly contemplated and hereby disclosed that the principles described herein may also be applied to cases in which the lengths of the subbands may vary from one target frame to another, and/or in which the lengths of two or more (possibly all) of the set of subbands within a target frame may differ.

An audio encoder that includes an implementation of apparatus A100 may be configured to receive frames of an audio signal (e.g., an LPC residual) as samples in a transform domain (e.g., as transform coefficients, such as MDCT coefficients or FFT coefficients). Such an encoder may be implemented to encode each frame by grouping the transform coefficients into a set of subbands according to a predetermined division scheme (i.e., a fixed division scheme that is known to the decoder before the frame is received) and encoding each subband using a gain-shape vector quantization scheme. In one example of such a predetermined division scheme, each 100-element input vector is divided into three subvectors of respective lengths (25, 35, 40).

For audio signals having high harmonic content (e.g., music signals, voiced speech signals), the locations of regions of significant energy in the frequency domain at a given time may be relatively persistent over time. It may be desirable to perform efficient transform-domain coding of an audio signal by exploiting such a correlation over time. In one such example, a dynamic subband selection scheme is used to match perceptually important (e.g., high-energy) subbands of a frame to be encoded with corresponding perceptually important subbands of the previous frame as decoded (also called "dependent-mode coding"). In a particular application, such a scheme is used to encode MDCT transform coefficients corresponding to the 0-4 kHz range of an audio signal, such as a residual of a linear prediction coding (LPC) operation. Additional description of dependent-mode coding may be found in the applications listed above to which this application claims priority.

In another example, the locations of each of a selected set of subbands of a harmonic signal are modeled using a selected value for the fundamental frequency F0 and a selected value for the spacing between adjacent peaks in the frequency domain. Additional description of such harmonic modeling may be found in the applications listed above to which this application claims priority.

It may be desirable to configure an audio codec to code different frequency bands of the same signal separately. For example, it may be desirable to configure such a codec to produce a first encoded signal that encodes a lowband portion of an audio signal and a second encoded signal that encodes a highband portion of the same audio signal. Applications in which such split-band coding may be desirable include wideband encoding systems that must remain compatible with narrowband decoding systems. Such applications also include generalized audio coding schemes that achieve efficient coding of a range of different types of audio input signals (e.g., both speech and music) by supporting the use of different coding schemes for different frequency bands.

For a case in which different frequency bands of a signal are encoded separately, it may be possible in some cases to increase coding efficiency in one band by using encoded (e.g., quantized) information from another band, as this encoded information will already be known at the decoder. For example, a relaxed harmonic model may be applied to use information from a decoded representation of the transform coefficients of a first band of an audio signal frame (also called the "source" band) to encode the transform coefficients of a second band of the same audio signal frame (also called the band "to be modeled"). For such a case in which the harmonic model is relevant, coding efficiency may be increased because the decoded representation of the first band is already available at the decoder.

Such an extended method may include determining subbands of the second band that are harmonically related to the coded first band. In low-bit-rate coding algorithms for audio signals (for example, complex music signals), it may be desirable to split a frame of the signal into multiple bands (e.g., a lowband and a highband) and to exploit a correlation between these bands to efficiently code the transform domain representation of the bands.

In a particular example of such extension, the MDCT coefficients corresponding to the 3.5-7 kHz band of an audio signal frame (henceforth referred to as upperband MDCT or UB-MDCT) are encoded based on harmonic information from the quantized lowband MDCT spectrum (0-4 kHz) of the frame. It is explicitly noted that in other examples of such extension, the two frequency ranges need not overlap and may even be separated (e.g., coding a 7-14 kHz band of a frame based on information from a decoded representation of the 0-4 kHz band). Additional description of harmonic modeling may be found in the applications listed above to which this application claims priority.

Figure 13B:
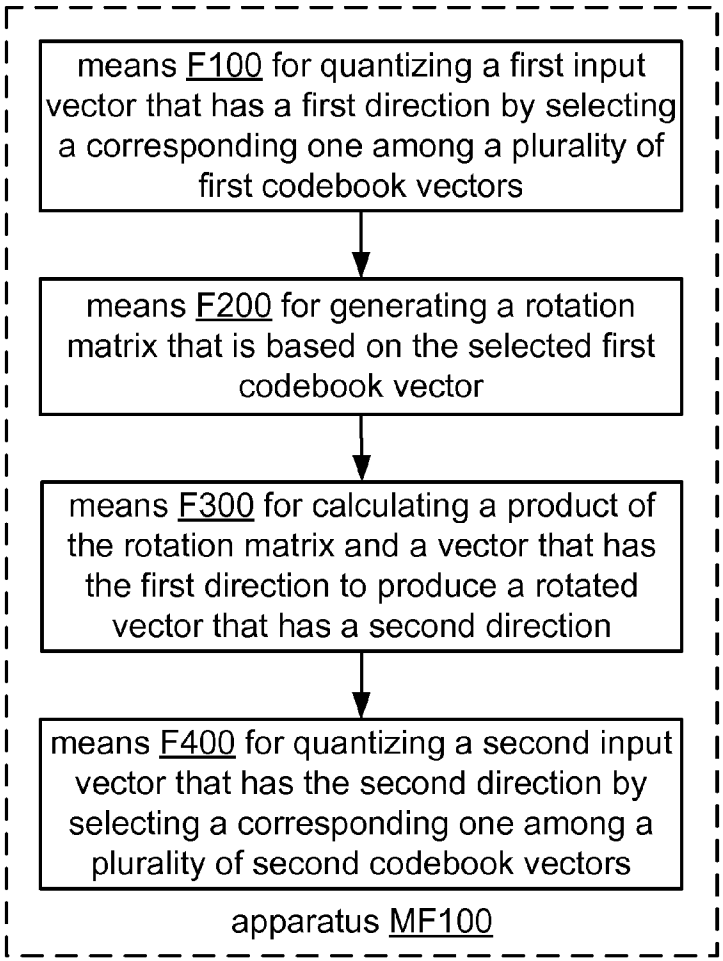
FIG. 13B shows a block diagram of an apparatus for vector quantization MF100 according to a general configuration.
Figure 13A:
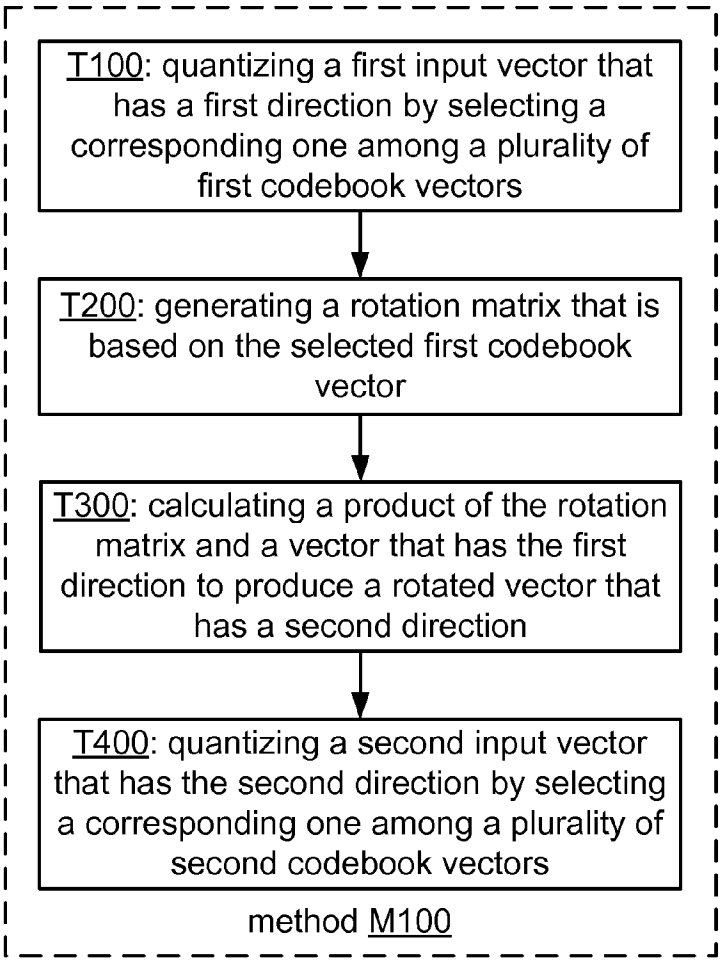
FIG. 13A shows a flowchart for a method for vector quantization M100 according to a general configuration.

FIG. 13A shows a flowchart for a method of vector quantization M100 according to a general configuration that includes tasks T100, T200, T300, and T400. Task T100 quantizes a first input vector that has a first direction by selecting a corresponding one among a plurality of first codebook vectors of a first codebook (e.g., as described herein with reference to shape quantizer SQ100). Task T200 generates a rotation matrix that is based on the selected first codebook vector (e.g., as described herein with reference to rotation matrix generator 200). Task T300 calculates a product of (A) a vector that has the first direction and (B) the rotation matrix to produce a rotated vector that has a second direction (e.g., as described herein with reference to multiplier ML10). Task T400 quantizes a second input vector that has the second direction by selecting a corresponding one among a plurality of second codebook vectors of a second codebook (e.g., as described herein with reference to second shape quantizer SQ200).

FIG. 13B shows a block diagram of an apparatus for vector quantization MF100 according to a general configuration. Apparatus MF100 includes means F100 for quantizing a first input vector that has a first direction by selecting a corresponding one among a plurality of first codebook vectors of a first codebook (e.g., as described herein with reference to shape quantizer SQ100). Apparatus MF100 also includes means F200 for generating a rotation matrix that is based on the selected first codebook vector (e.g., as described herein with reference to rotation matrix generator 200). Apparatus MF100 also includes means F300 for calculating a product of (A) a vector that has the first direction and (B) the rotation matrix to produce a rotated vector that has a second direction (e.g., as described herein with reference to multiplier ML10). Apparatus MF100 also includes means F400 for quantizing a second input vector that has the second direction by selecting a corresponding one among a plurality of second codebook vectors of a second codebook (e.g., as described herein with reference to second shape quantizer SQ200).

Figure 14A:
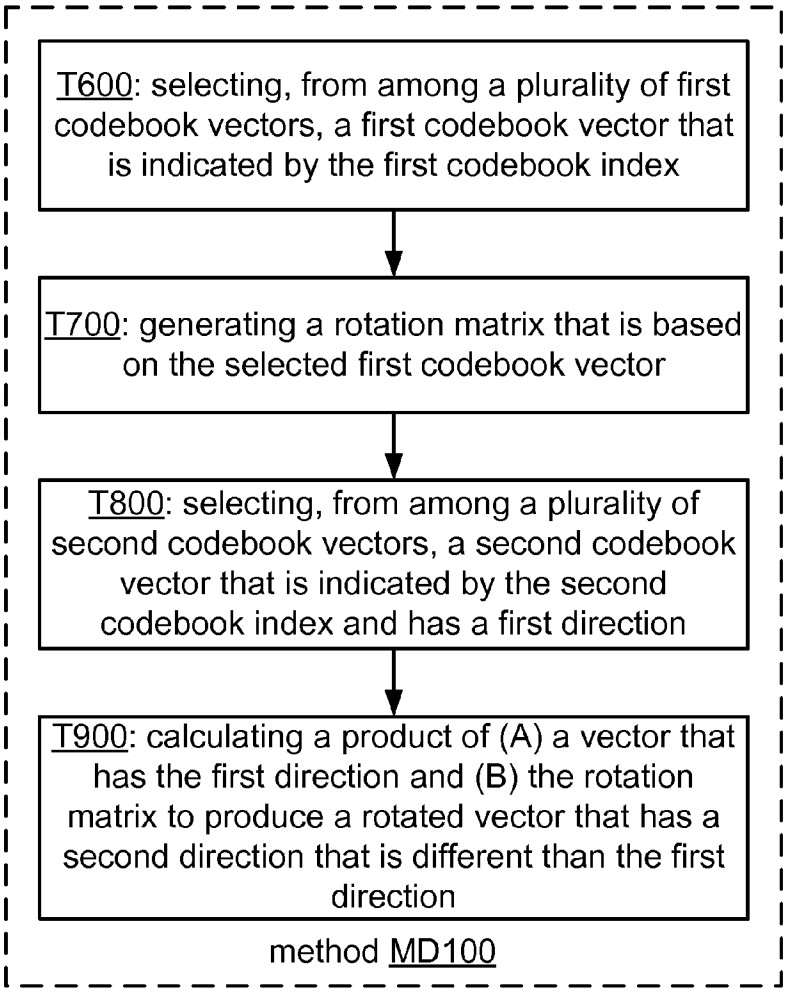
FIG. 14A shows a flowchart for a method for vector dequantization MD100 according to a general configuration.

FIG. 14A shows a flowchart for a method for vector dequantization MD100 according to a general configuration that includes tasks T600, T700, T800, and T900. Task T600 selects, from among a plurality of first codebook vectors of a first codebook, a first codebook vector that is indicated by the first codebook index (e.g., as described herein with reference to first shape dequantizer 500). Task T700 generates a rotation matrix that is based on the selected first codebook vector (e.g., as described herein with reference to rotation matrix generator 210). Task T800 selects, from among a plurality of second codebook vectors of a second codebook, a second codebook vector that is indicated by the second codebook index and has a first direction (e.g., as described herein with reference to second shape dequantizer 600). Task T900 calculates a product of (A) a vector that has the first direction and (B) the rotation matrix to produce a rotated vector that has a second direction that is different than the first direction (e.g., as described herein with reference to multiplier ML30).

Figure 14B:
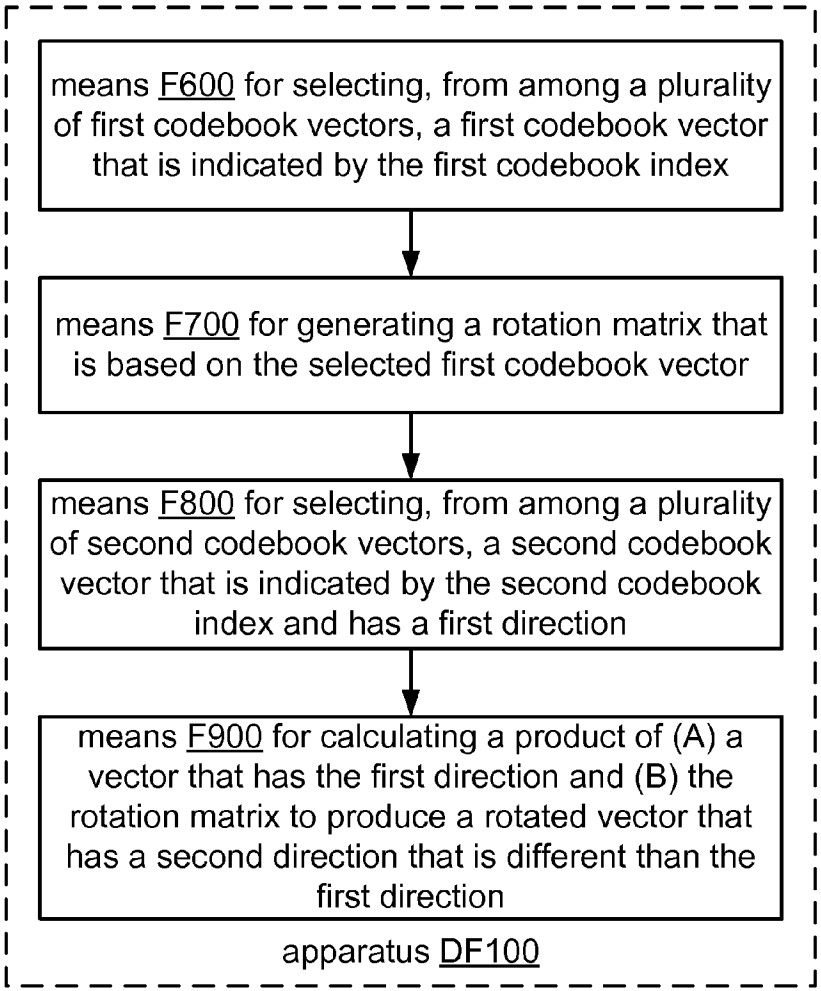
FIG. 14B shows a block diagram of an apparatus for vector dequantization DF100 according to a general configuration.

FIG. 14B shows a block diagram of an apparatus for vector dequantization DF100 according to a general configuration. Apparatus DF100 includes means F600 for selecting, from among a plurality of first codebook vectors of a first codebook, a first codebook vector that is indicated by the first codebook index (e.g., as described herein with reference to first shape dequantizer 500). Apparatus DF100 also includes means F700 for generating a rotation matrix that is based on the selected first codebook vector (e.g., as described herein with reference to rotation matrix generator 210). Apparatus DF100 also includes means F800 for selecting, from among a plurality of second codebook vectors of a second codebook, a second codebook vector that is indicated by the second codebook index and has a first direction (e.g., as described herein with reference to second shape dequantizer 600). Apparatus DF100 also includes means F900 for calculating a product of (A) a vector that has the first direction and (B) the rotation matrix to produce a rotated vector that has a second direction that is different than the first direction (e.g., as described herein with reference to multiplier ML30).

Figure 12B:
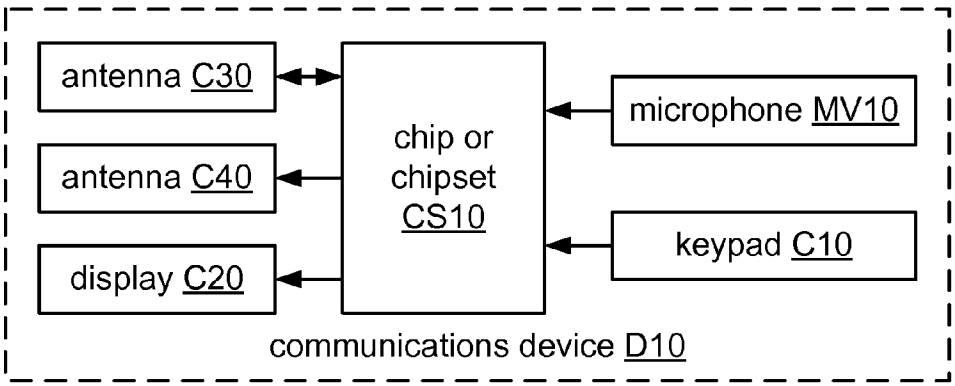
FIG. 12B shows a block diagram of a communications device D10 that includes an implementation of apparatus A100.

FIG. 12B shows a block diagram of a communications device D10 that includes an implementation of apparatus A100. Device D10 includes a chip or chipset CS10 (e.g., a mobile station modem (MSM) chipset) that embodies the elements of apparatus A100 (or MF100) and possibly of apparatus D100 (or DF100). Chip/chipset CS10 may include one or more processors, which may be configured to execute a software and/or firmware part of apparatus A100 or MF100 (e.g., as instructions).

Chip/chipset CS10 includes a receiver, which is configured to receive a radio-frequency (RF) communications signal and to decode and reproduce an audio signal encoded within the RF signal, and a transmitter, which is configured to transmit an RF communications signal that describes an encoded audio signal (e.g., including codebook indices as produced by apparatus A100) that is based on a signal produced by microphone MV10. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). For example, chip or chipset CS10 may be configured to produce the encoded frames to be compliant with one or more such codecs.

Device D10 is configured to receive and transmit the RF communications signals via an antenna C30. Device D10 may also include a diplexer and one or more power amplifiers in the path to antenna C30. Chip/chipset CS10 is also configured to receive user input via keypad C10 and to display information via display C20. In this example, device D10 also includes one or more antennas C40 to support Global Positioning System (GPS) location services and/or short-range communications with an external device such as a wireless (e.g., Bluetooth™) headset. In another example, such a communications device is itself a Bluetooth™ headset and lacks keypad C10, display C20, and antenna C30.

Figure 15:
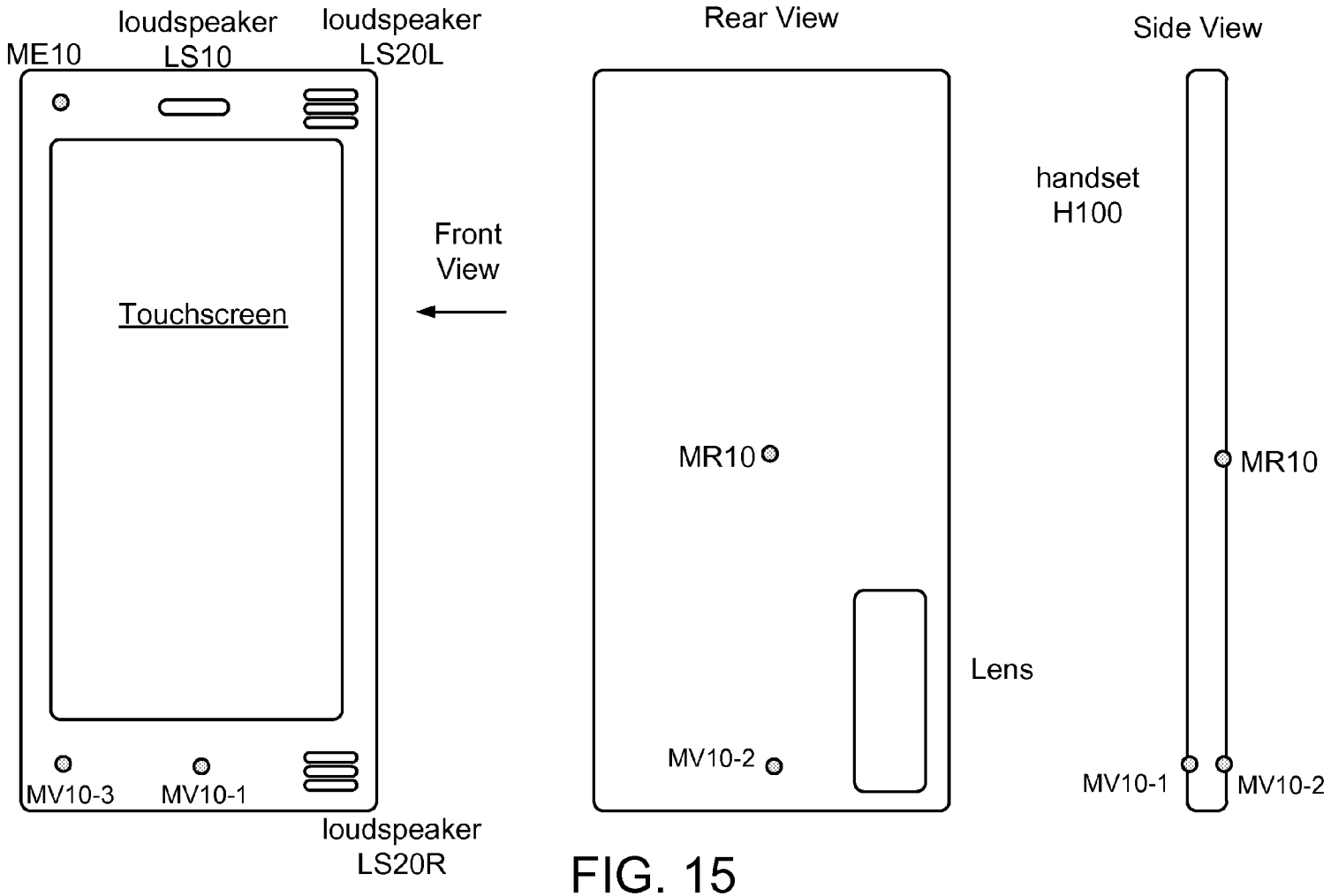
FIG. 15 shows front, rear, and side views of a handset H100.

Communications device D10 may be embodied in a variety of communications devices, including smartphones and laptop and tablet computers. FIG. 15 shows front, rear, and side views of a handset H100 (e.g., a smartphone) having two voice microphones MV10-1 and MV10-3 arranged on the front face, a voice microphone MV10-2 arranged on the rear face, an error microphone ME10 located in a top corner of the front face, and a noise reference microphone MR10 located on the back face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

An apparatus as disclosed herein (e.g., apparatus A100, A110, D100, MF100, or DF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100, A110, D100, MF100, or DF100) may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 or MD100, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M100, MD100, and other methods disclosed with reference to the operation of the various apparatus described herein) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The invention claimed is:

1. An apparatus for vector quantization, said apparatus comprising:

a first vector quantizer configured to receive a first input vector that has a first direction and to select a corresponding one among a plurality of first codebook vectors of a first codebook, wherein the first vector quantizer is implemented by the apparatus, and wherein the apparatus comprises hardware;

a rotation matrix generator configured to generate a rotation matrix that is based on the selected first codebook vector;

a multiplier configured to calculate a product of (A) a vector that has the first direction and (B) the rotation matrix to produce a rotated vector that has a second direction that is different than the first direction; and a second vector quantizer configured to receive a second input vector that has the second direction and to select a corresponding one among a plurality of second codebook vectors of a second codebook.

2. The apparatus according to claim 1, wherein each among the plurality of first codebook vectors and the plurality of second codebook vectors is a unit-norm vector.

3. The apparatus according to claim 1, wherein the first vector quantizer is configured to select the first codebook from among a plurality of codebooks, based on a gain value of the first input vector.

4. The apparatus according to claim 1, wherein, for each among the plurality of first codebook vectors, an inner product of the first input vector with the codebook vector is not greater than an inner product of the first input vector and the selected first codebook vector.

5. The apparatus according to claim 1, wherein the first input vector is one among a plurality of subband vectors of a frame of an audio signal, and wherein said apparatus includes a gain quantizer configured to encode an average gain value of the plurality of subband vectors, based on an average gain value of a previous frame of the audio signal.

6. The apparatus according to claim 1, wherein each of the elements of at least one row of the rotation matrix is based on a corresponding element of the selected first codebook vector.

7. The apparatus according to claim 1, wherein each of the elements of at least one column of the rotation matrix is based on a corresponding element of the selected first codebook vector.

8. The apparatus according to claim 1, wherein the rotation matrix is based on a reference vector that is independent of the first input vector.

9. The apparatus according to claim 8, wherein the reference vector has only one nonzero element.

10. The apparatus according to claim 8, wherein the rotation matrix defines a rotation of the selected first codebook vector, within a plane that includes the selected first codebook vector and the reference vector, to the direction of the reference vector.

11. The apparatus according to claim 1, wherein said multiplier is configured to calculate said product of a vector that has the first direction and the rotation matrix by calculating a product of the rotation matrix and said first input vector.

12. The apparatus according to claim 1, wherein said selected first codebook vector is based on a pattern of unit pulses.

13. A method of vector quantization, said method comprising:

quantizing a first input vector that has a first direction by selecting a corresponding one among a plurality of first codebook vectors of a first codebook;

generating a rotation matrix that is based on the selected first codebook vector;

calculating a product of (A) a vector that has the first direction and (B) the rotation matrix to produce a rotated vector that has a second direction that is different than the first direction; and quantizing a second input vector that has the second direction by selecting a corresponding one among a plurality of second codebook vectors of a second codebook.

14. The method according to claim 13, wherein each among the plurality of first codebook vectors and the plurality of second codebook vectors is a unit-norm vector.

15. The method according to claim 13, wherein said quantizing a first input vector includes selecting the first codebook from among a plurality of codebooks, based on a gain value of the first input vector.

16. The method according to claim 13, wherein, for each among the plurality of first codebook vectors, an inner product of the first input vector with the codebook vector is not greater than an inner product of the first input vector and the selected first codebook vector.

17. The method according to claim 13, wherein the first input vector is one among a plurality of subband vectors of a frame of an audio signal, and wherein said method includes encoding an average gain value of the plurality of subband vectors, based on an average gain value of a previous frame of the audio signal.

18. The method according to claim 13, wherein each of the elements of at least one row of the rotation matrix is based on a corresponding element of the selected first codebook vector.

19. The method according to claim 13, wherein each of the elements of at least one column of the rotation matrix is based on a corresponding element of the selected first codebook vector.

20. The method according to claim 13, wherein the rotation matrix is based on a reference vector that is independent of the first input vector.

21. The method according to claim 20, wherein the reference vector has only one nonzero element.

22. The method according to claim 20, wherein the rotation matrix defines a rotation of the selected first codebook vector, within a plane that includes the selected first codebook vector and the reference vector, to the direction of the reference vector.

23. The method according to claim 13, wherein said calculating said product of the vector that has the first direction and the rotation matrix is performed by calculating a product of the rotation matrix and said first input vector.

24. The method according to claim 13, wherein said selected first codebook vector is based on a pattern of unit pulses.

25. An apparatus for vector quantization, said apparatus comprising:

means for quantizing a first input vector that has a first direction by selecting a corresponding one among a plurality of first codebook vectors of a first codebook;

means for generating a rotation matrix that is based on the selected first codebook vector;

means for calculating a product of (A) a vector that has the first direction and (B) the rotation matrix to produce a rotated vector that has a second direction that is different than the first direction; and means for quantizing a second input vector that has the second direction by selecting a corresponding one among a plurality of second codebook vectors of a second codebook.

26. The apparatus according to claim 25, wherein each among the plurality of first codebook vectors and the plurality of second codebook vectors is a unit-norm vector.

27. The apparatus according to claim 25, wherein said means for quantizing a first input vector is configured to select the first codebook from among a plurality of codebooks, based on a gain value of the first input vector.

28. The apparatus according to claim 25, wherein, for each among the plurality of first codebook vectors, an inner product of the first input vector with the codebook vector is not greater than an inner product of the first input vector and the selected first codebook vector.

29. The apparatus according to claim 25, wherein the first input vector is one among a plurality of subband vectors of a frame of an audio signal, and wherein said apparatus includes means for encoding an average gain value of the plurality of subband vectors, based on an average gain value of a previous frame of the audio signal.

30. The apparatus according to claim 25, wherein each of the elements of at least one row of the rotation matrix is based on a corresponding element of the selected first codebook vector.

31. The apparatus according to claim 25, wherein each of the elements of at least one column of the rotation matrix is based on a corresponding element of the selected first codebook vector.

32. The apparatus according to claim 25, wherein the rotation matrix is based on a reference vector that is independent of the first input vector.

33. The apparatus according to claim 32, wherein the reference vector has only one nonzero element.

34. The apparatus according to claim 32, wherein the rotation matrix defines a rotation of the selected first codebook vector, within a plane that includes the selected first codebook vector and the reference vector, to the direction of the reference vector.

35. The apparatus according to claim 25, wherein said means for calculating a product is configured to calculate said product of a vector that has the first direction and the rotation matrix by calculating a product of the rotation matrix and said first input vector.

36. The apparatus according to claim 25, wherein said selected first codebook vector is based on a pattern of unit pulses.

37. An apparatus for dequantizing a quantized vector that includes a first codebook index and a second codebook index, said apparatus comprising:

a first vector dequantizer configured to receive the first codebook index and to produce a corresponding first codebook vector from a first codebook;

a rotation matrix generator configured to generate a rotation matrix that is based on the first codebook vector;

a second vector dequantizer configured to receive a second codebook index and to produce, from a second codebook, a corresponding second codebook vector that has a first direction; and a multiplier configured to calculate a product of (A) a vector that has the first direction and (B) the rotation matrix to produce a rotated vector that has a second direction that is different than the first direction.

38. A method of dequantizing a quantized vector that includes a first codebook index and a second codebook index, said method comprising:

selecting, from among a plurality of first codebook vectors of a first codebook, a first codebook vector that is indicated by the first codebook index;

generating a rotation matrix that is based on the selected first codebook vector;

selecting, from among a plurality of second codebook vectors of a second codebook, a second codebook vector that is indicated by the second codebook index and has a first direction;

calculating a product of (A) a vector that has the first direction and (B) the rotation matrix to produce a rotated vector that has a second direction that is different than the first direction.

39. An apparatus for dequantizing a quantized vector that includes a first codebook index and a second codebook index, said apparatus comprising:

means for selecting, from among a plurality of first codebook vectors of a first codebook, a first codebook vector that is indicated by the first codebook index;

means for generating a rotation matrix that is based on the selected first codebook vector;

means for selecting, from among a plurality of second codebook vectors of a second codebook, a second codebook vector that is indicated by the second codebook index and has a first direction;

means for calculating a product of (A) a vector that has the first direction and (B) the rotation matrix to produce a rotated vector that has a second direction that is different than the first direction.

40. A non-transitory computer-readable storage medium having tangible features that cause a machine reading the features to:

quantize a first input vector that has a first direction by selecting a corresponding one among a plurality of first codebook vectors of a first codebook;

generate a rotation matrix that is based on the selected first codebook vector;

calculate a product of (A) a vector that has the first direction and (B) the rotation matrix to produce a rotated vector that has a second direction that is different than the first direction; and quantize a second input vector that has the second direction by selecting a corresponding one among a plurality of second codebook vectors of a second codebook.

* * * * *